US008201701B2

(12) United States Patent
Yamauchi

(10) Patent No.: US 8,201,701 B2
(45) **Date of Patent: *Jun. 19, 2012**

(54) FOLDING CONTAINER

(75) Inventor: Hisatoshi Yamauchi, Mizuho (JP)

(73) Assignee: Sanko Co., Ltd., Mizuho-shi (JP)

( * ) Notice: Subject to any disclaimer, the term of this patent is extended or adjusted under 35 U.S.C. 154(b) by 280 days.

This patent is subject to a terminal disclaimer.

(21) Appl. No.: 12/544,310

(22) Filed: Aug. 20, 2009

(65) Prior Publication Data

US 2010/0320202 A1 Dec. 23, 2010

(30) Foreign Application Priority Data

Jun. 18, 2009 (JP) ..... 2009-144970

(51) Int. Cl.
*B65D 6/18* (2006.01)

(52) U.S. Cl. ..... 220/7; 220/6

(58) Field of Classification Search ..... 220/6, 7
See application file for complete search history.

(56) References Cited

U.S. PATENT DOCUMENTS

| | | | | |
|---|---|---|---|---|
| 5,207,899 | A * | 5/1993 | Boyle | 210/138 |
| 5,632,392 | A * | 5/1997 | Oh | 220/7 |
| 6,290,081 | B1 * | 9/2001 | Merey | 220/7 |
| 6,843,386 | B2 | 1/2005 | Raghunathan et al. | |
| 7,011,225 | B2 * | 3/2006 | Oster et al. | 220/7 |
| 7,195,128 | B2 * | 3/2007 | Murakami et al. | 220/7 |
| 7,861,878 | B2 * | 1/2011 | Escarpa Gil | 220/7 |
| 2003/0000950 | A1 | 1/2003 | Murakami et al. | |
| 2010/0230406 | A1 * | 9/2010 | Yamauchi | 220/7 |
| 2010/0320202 | A1 | 12/2010 | Yamauchi | |
| 2011/0049145 | A1 * | 3/2011 | Yamauchi | 220/7 |

FOREIGN PATENT DOCUMENTS

JP 2003-040263 * 2/2003

OTHER PUBLICATIONS

See corresponding U.S. Appl. No. 12/699,448 allowed in first action on Jan. 3, 2012.
US Office Action dated Jun. 24, 2011, issued in U.S. Appl. No. 12/544,358.

* cited by examiner

*Primary Examiner* — Stephen Castellano
(74) *Attorney, Agent, or Firm* — Westerman, Hattori, Daniels & Adrian, LLP

(57) ABSTRACT

A lock member L composed of one operation portion La biased by an inclined spring member 12 and paired lock bars Lb is attached to each of side walls 3 to be brought down firstly. A driven pin 15 formed on an operation portion is inserted through an inclined cam groove 21*a* of each of the lock bars. The lock member is attached to the side wall to be brought down firstly by fitting a pivotal shaft 11*b* formed on the operation portion into a fitting recess portion 3*j*1 of a pivotal shaft support block 3*j* formed on the side wall to be brought down firstly. Thus, at whichever position on the operation portion the operator' finger are laid, the lateral paired lock bars disposed opposite each other across the operation portion are moved in the horizontal direction by the same amount. Consequently, the lock state established between the short side wall and the long side wall via the lock member can be reliably cancelled.

4 Claims, 19 Drawing Sheets

La

FOLDING CONTAINER

FIELD OF THE INVENTION

The present invention relates to a folding container in which side walls disposed so as to surround a bottom portion can be folded so as to lie on top of the bottom portion.

BACKGROUND OF THE INVENTION

Folding containers are conventionally known which are composed of long side walls connected, via hinge members, to respective opposite long side portions of a bottom portion formed so as to have a rectangular planar shape and short side walls also connected, via hinge members, to respective opposite short side portions of the bottom portion. The long side walls and the short side walls are set up perpendicularly to the bottom portion to assemble the side walls and the bottom portion into a box form. Furthermore, when the folding container is folded, the long side walls and the short side walls are folded so as to lie on top of the bottom portion. With the folding container assembled in the box form, the long side walls and the short side walls are locked by lock members so as to prevent the long side walls or the short side walls from falling down toward the bottom portion.

By way of example, U.S. Pat. No. 6,290,081 (the embodiment shown in FIGS. 9 to 13) discloses a lock member disposed on each short side wall and composed of one operation portion that is movable along the wall surface of the short side wall, paired lock bars that are movable in the horizontal direction, and a vertical-movement-to-horizontal-movement converting mechanism composed of an inclined cam groove formed in the lock bar and a driven pin projected from the operation portion, the vertical-movement-to-horizontal-movement converting mechanism converting vertical movement of the operation portion into horizontal movement of the lock bars.

When the operation portion is located at a lower position, the tip portion of each of the lock bars is inserted into a fitting recess portion formed in each long side wall to lock the short side wall on the long side wall so as to prevent the short side wall from falling down toward a bottom portion. Furthermore, when the operation portion located at the lower position is moved upward along the wall surface of the short side wall, the paired lock bars are moved horizontally in the direction in which the lock bars approach each other to remove the tip portion of each of the lock bars from the fitting recess portion formed in the long side wall. This cancels the lock state established between the short side wall and the long side wall via the lock member. Thus, the short side wall can be brought down so as to lie on top of the bottom portion.

According to the above-described conventional folding container, when the folding container in an assembled box form is folded, an operator moves the operation portion upward. However, depending on the position of the operator's hand with respect to the operation portion, the operation portion may be tilted instead of remaining lying horizontally, during the upward movement. If the operation portion is tilted during the upward movement, the paired lock bars coupled to the operation portion via the vertical-movement-to-horizontal-movement converting mechanism are inhibited from being smoothly moved in the horizontal direction. This may disadvantageously result in the unreliable cancellation of the lock state established between the long side wall and the short side wall via the vertical-movement-to-horizontal-movement converting mechanism.

Furthermore, a handheld through-hole into which the operator inserts the operator's hand to carry the folding container in an assembled box form is located close to an operation portion operating recess portion into which the operator inserts the operator's hand to move the operation portion of the lock member upward. Thus, in carrying the folding container in the assembled box form, the operator may accidentally insert the operator's hand into the operation portion operating recess portion to move the operation portion upward. As a result, the lock state between the short side wall and the long side wall may disadvantageously be cancelled.

Moreover, when the folding container is in the assembled box form, the operation portion, a leaf spring forming the operation portion, and the vertical-movement-to-horizontal-movement converting mechanism are arranged in the operation portion operating recess portion that is open to the exterior of the short side wall. Thus, an external member may accidentally enter the operation portion operating recess portion. This may disadvantageously damage the operation portion, the leaf spring forming the operation portion, or the vertical-movement-to-horizontal-movement converting mechanism.

SUMMARY OF THE INVENTION

An object of the present invention is to solve the problems with the above-described conventional folding container.

To accomplish the object, the present invention provides a folding container having first opposite side walls which, when the folding container is in an assembled box form, are brought down firstly toward a bottom portion and second opposite side walls which are brought down secondly toward the bottom portion after the first opposite side walls haven been brought down, wherein first, a lock member comprising one operation portion biased by an inclined spring member and paired lock bars is disposed on each of the side walls to be brought down firstly, and a driven pin formed on the operation portion is inserted through an inclined cam groove formed in each of the lock bars, and the lock member is attached to the side wall to be brought down firstly by fitting a pivotal shaft formed on the operation portion into a fitting recess portion of a pivotal shaft support block formed on the side wall to be brought down firstly.

Secondly, a lock state between the side wall to be brought down firstly and the side wall to be brought down secondly is cancelled by pivotally moving the operation portion included in the lock member, downward toward an interior of the folding container using, as a pivotal support point, the pivotal shaft formed on the operation portion fitted in the fitting recess portion of the pivotal shaft support block formed on the side wall to be brought down firstly.

Thirdly, the inclined cam groove formed in the lock bar and a central space portion formed in the side wall to be brought down firstly are covered with a cover member.

In the folding container having the first opposite side walls which, when the folding container is in the assembled box form, are brought down firstly toward the bottom portion and the second opposite side walls which are brought down secondly toward the bottom portion after the first opposite side walls haven been brought down, the lock member comprising the one operation portion biased by the inclined spring member and the paired lock bars is disposed on each of the side walls to be brought down firstly, and the driven pin formed on the operation portion is inserted through the inclined cam groove formed in each of the lock bars, and the lock member is attached to the side wall to be brought down firstly by fitting the pivotal shaft formed on the operation portion into the fitting recess portion of the pivotal short-shaft support block formed on the side wall to be brought down firstly. Thus, at whichever position on the operation portion the operator' finger are laid, the lateral paired lock bars disposed opposite each other across the operation portion are moved in the horizontal direction by the same amount. Consequently, the lock state established between the short side wall and the long side wall via the lock member can be reliably cancelled.

Furthermore, the lock state between the side wall to be brought down firstly and the side wall to be brought down secondly is cancelled by pivotally moving the operation portion included in the lock member, downward toward the interior of the folding container using, as a pivotal support point, the pivotal shaft formed on the operation portion fitted in the fitting recess portion of the pivotal shaft support block formed on the side wall to be brought down firstly. Thus, in carrying the folding container in an assembled box form, the operator can be reliably prevented from accidentally touching and pivotally moving the operation portion downward.

Moreover, the inclined cam groove formed in the lock bar and a central space portion formed in the side wall to be brought down firstly are covered with the cover member. Thus, the operation portion and lock bar forming the lock member placed in the central space portion are prevented from being exposed to the outside of the side wall to be brought down firstly. Consequently, the operation portion and lock bar forming the lock member placed in the central space portion can be prevented from being damaged by an external member.

DETAILED DESCRIPTION OF THE PREFERRED EMBODIMENT

An embodiment of the present invention will be described below. However, the present invention is not limited to the embodiment, and any other embodiment is possible without departing from the spirit of the present invention.

Figure 1:
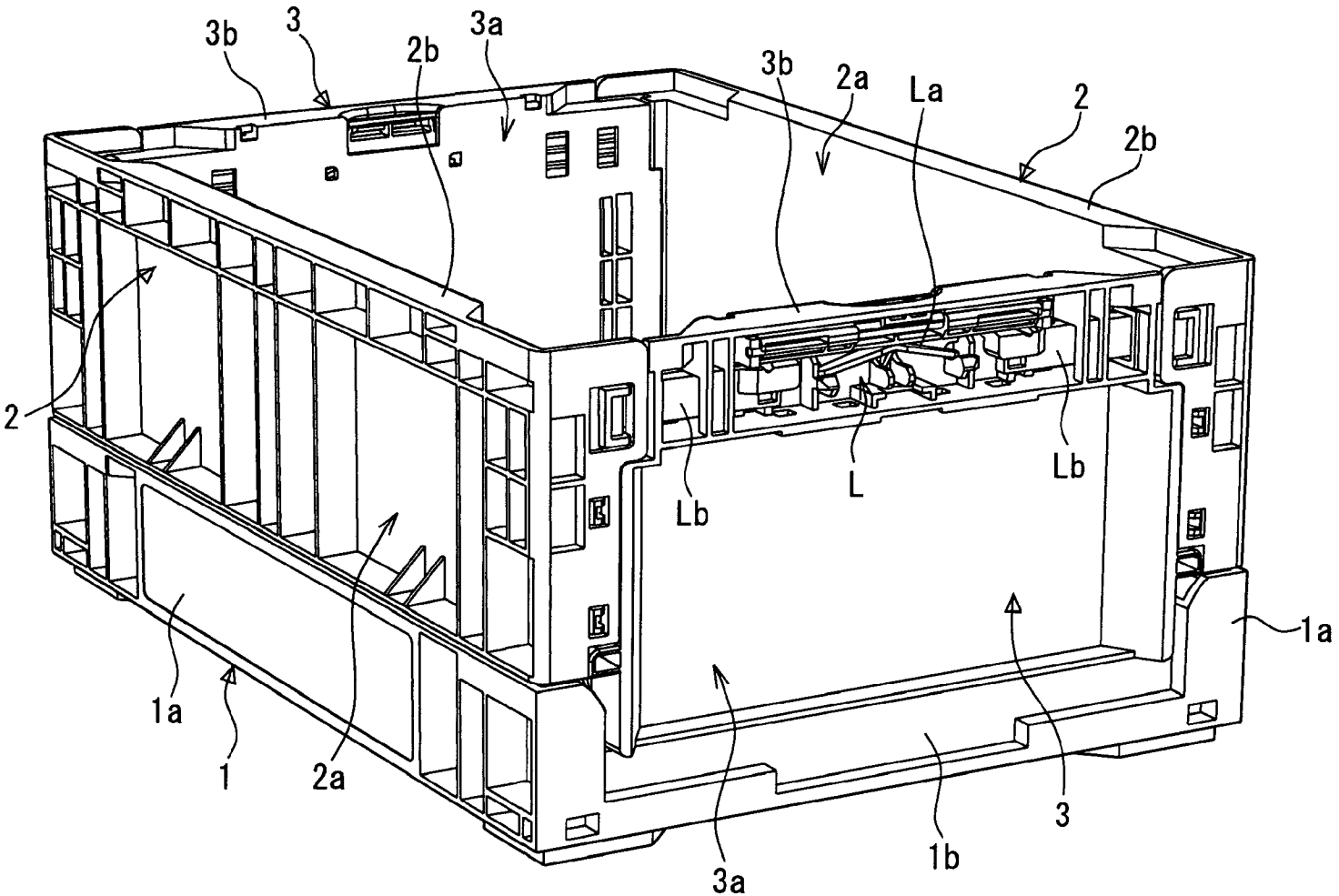
FIG. 1 is a general perspective view of a folding container according to the present invention assembled in a box form, with a cover member omitted from the figure.

As shown in FIG. 1, a folding container according to the present invention is composed of a bottom portion 1, long side walls 2 hinged to respective opposite long-side bank portions 1*a* of the bottom portion 1, and short side walls 3 hinged to respective opposite short-side bank portions 1*b* of the bottom portion 1. In the present embodiment, each of the long-side bank portions 1*a* is formed to be higher than each of the short-side bank portions 1*b*.

When the folding container is in an assembled box form as shown in FIG. 1, firstly, the short side walls 3 are brought down so as to lie on top of the bottom portion 1. Then, the long side walls 2 are brought down so as to lie on top of the short side walls 3 laid on top of the bottom portion 1. Thus, as is well known, the folding container can be folded into a low, compact form. Then, when the folding container is in a folded form, the long side walls 2 are set up vertically, and the short side walls 3 are set up vertically. Then, as shown in FIG. 1, the folding container can be assembled into the box form.

Figure 2:
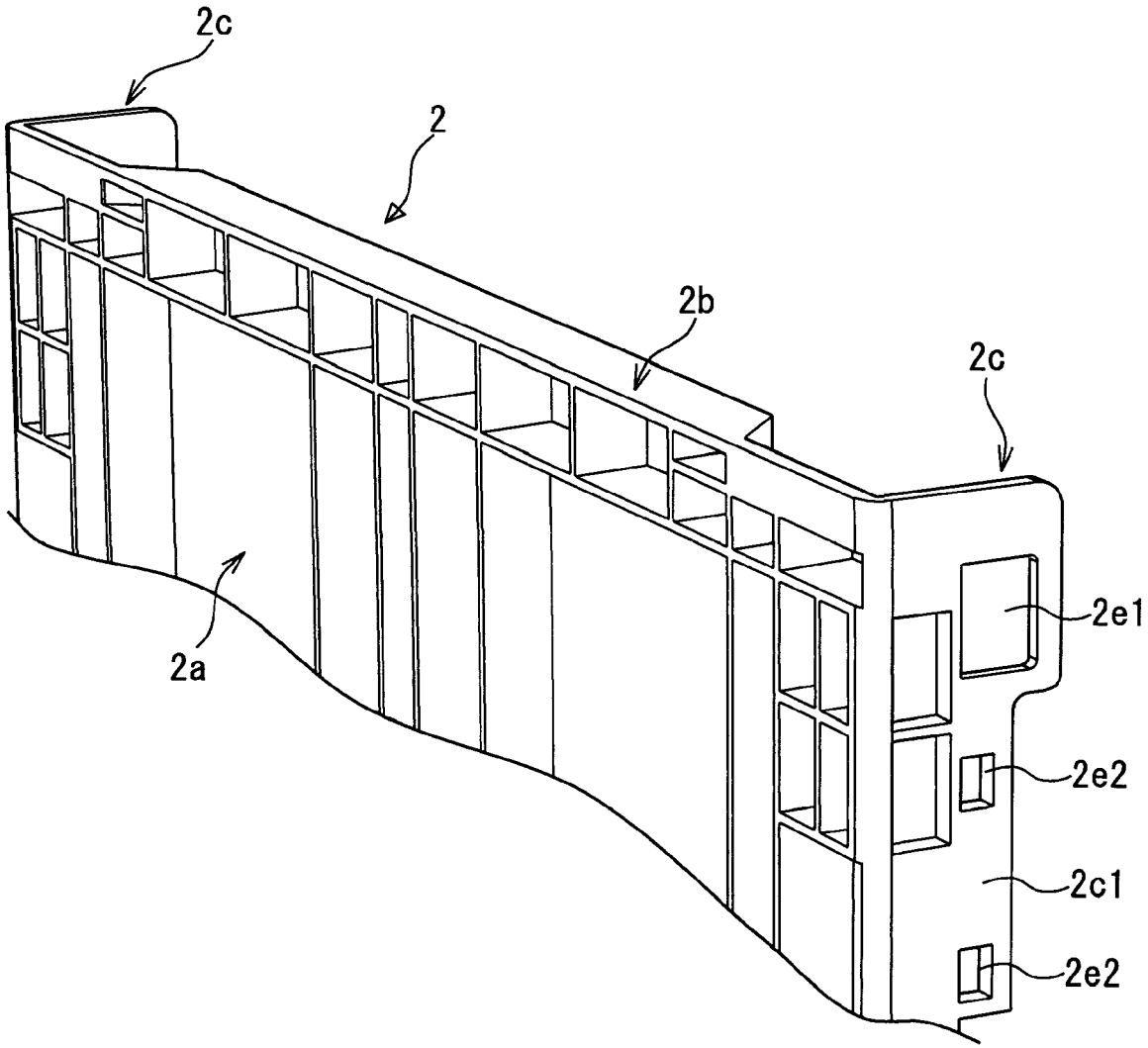
FIG. 2 is a partly enlarged perspective view of a long side wall included in the folding container according to the present invention.
Figure 3:
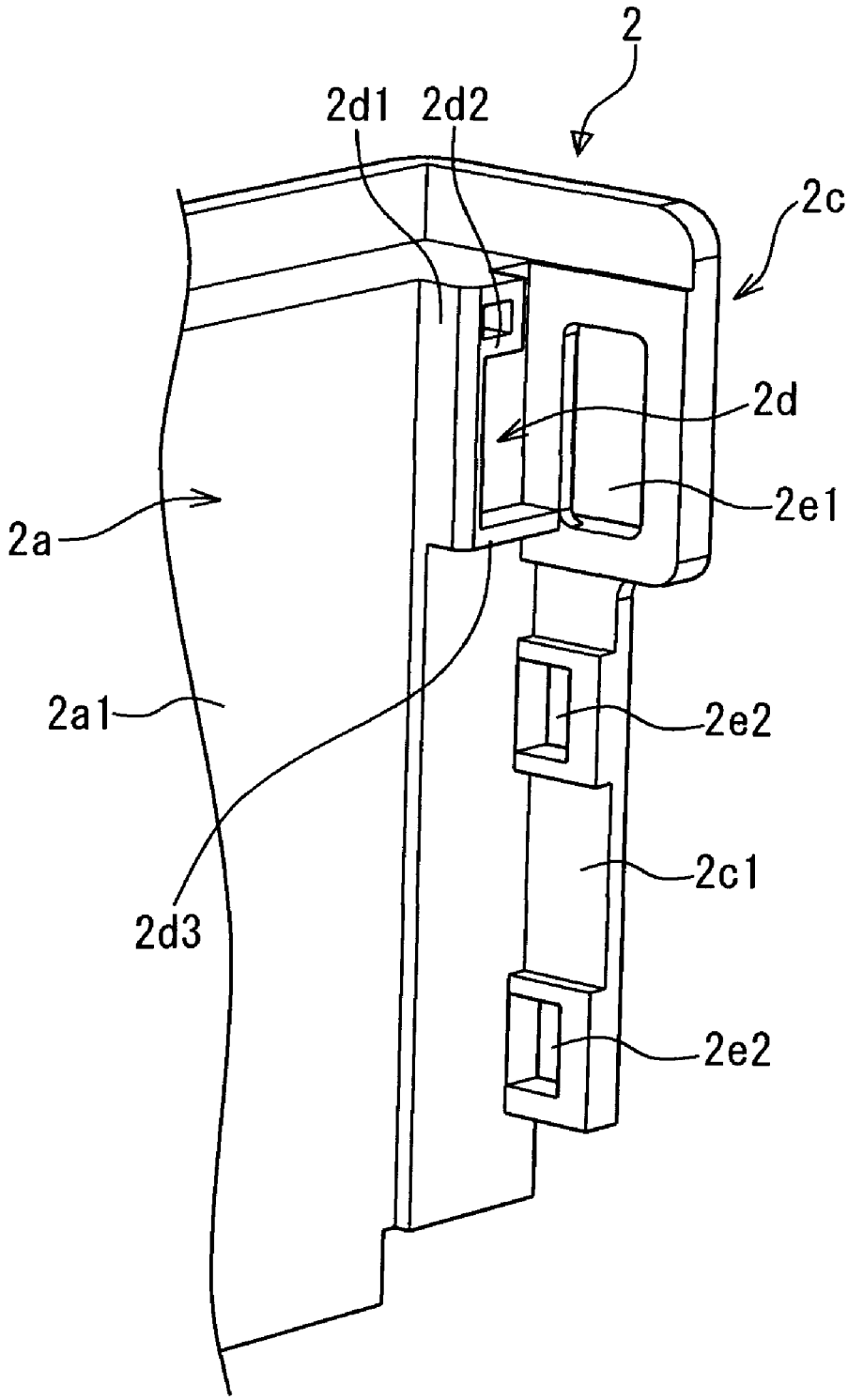
FIG. 3 is a partly enlarged perspective view of the long side wall included in the folding container according to the present invention.
Figure 4:
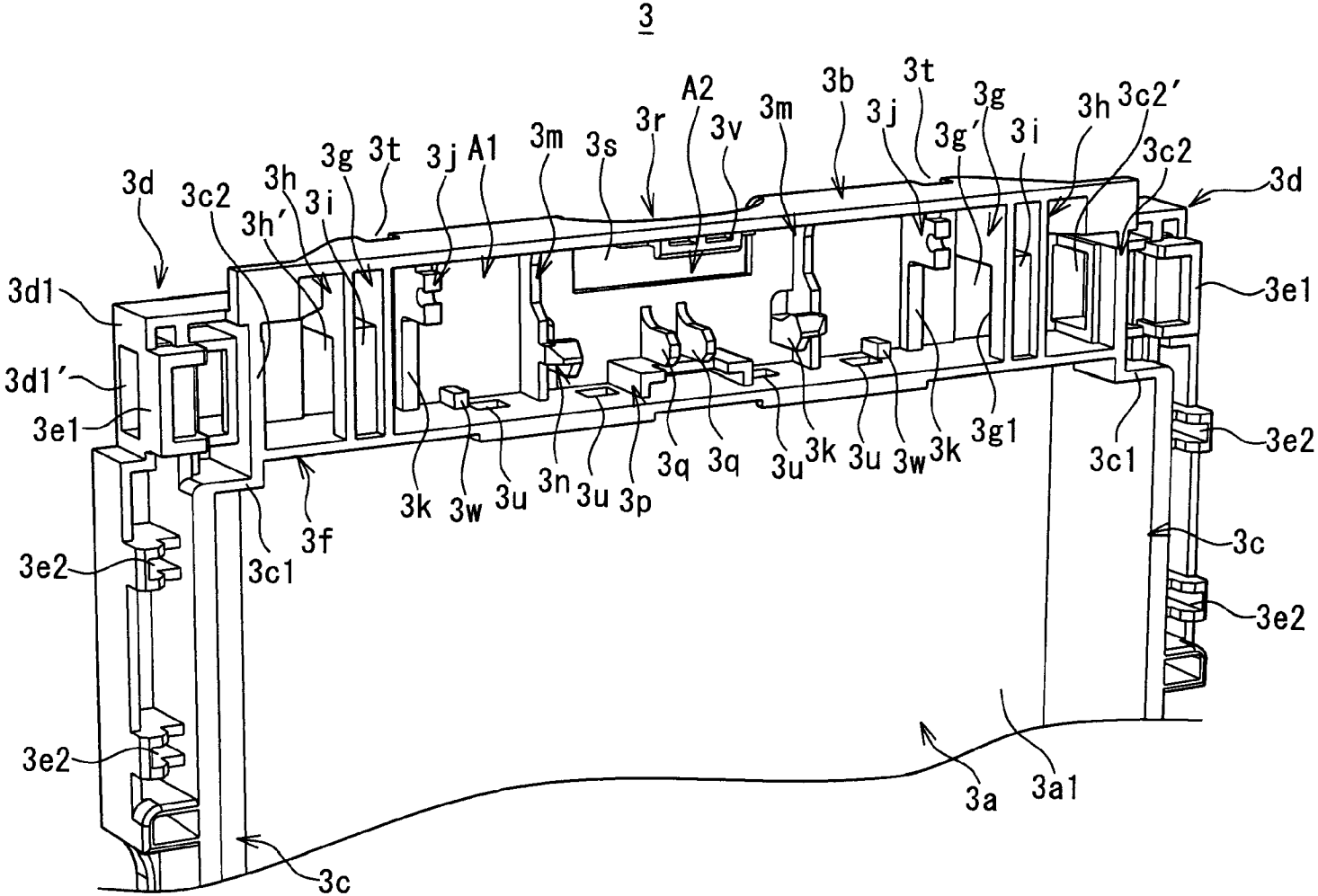
FIG. 4 is a partial perspective view of a short side wall included in the folding container according to the present invention, as viewed from the outside of the folding container.
Figure 5:
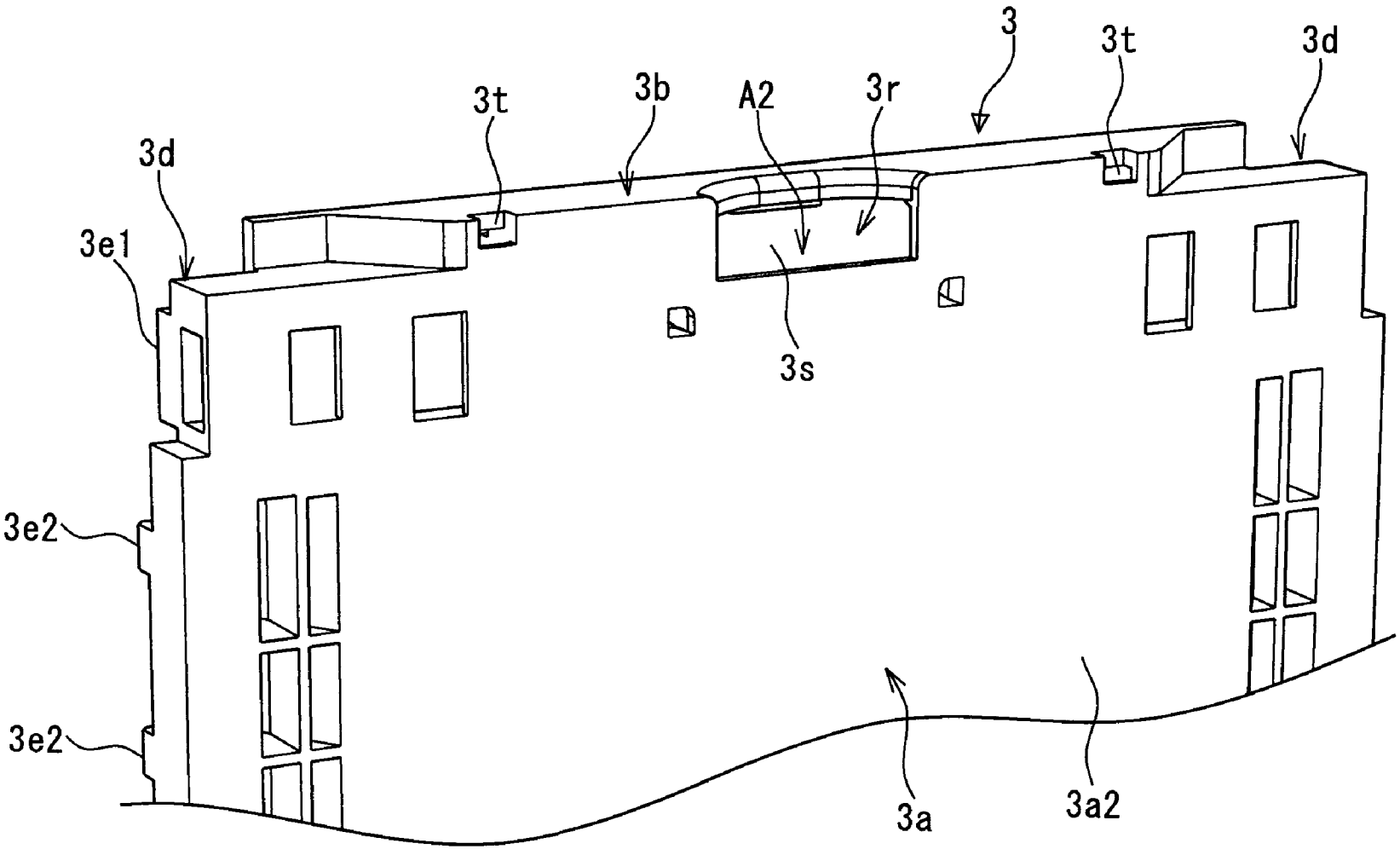
FIG. 5 is a partial perspective view of the short side wall included in the folding container according to the present invention, as viewed from the inside of the folding container.
Figure 6:
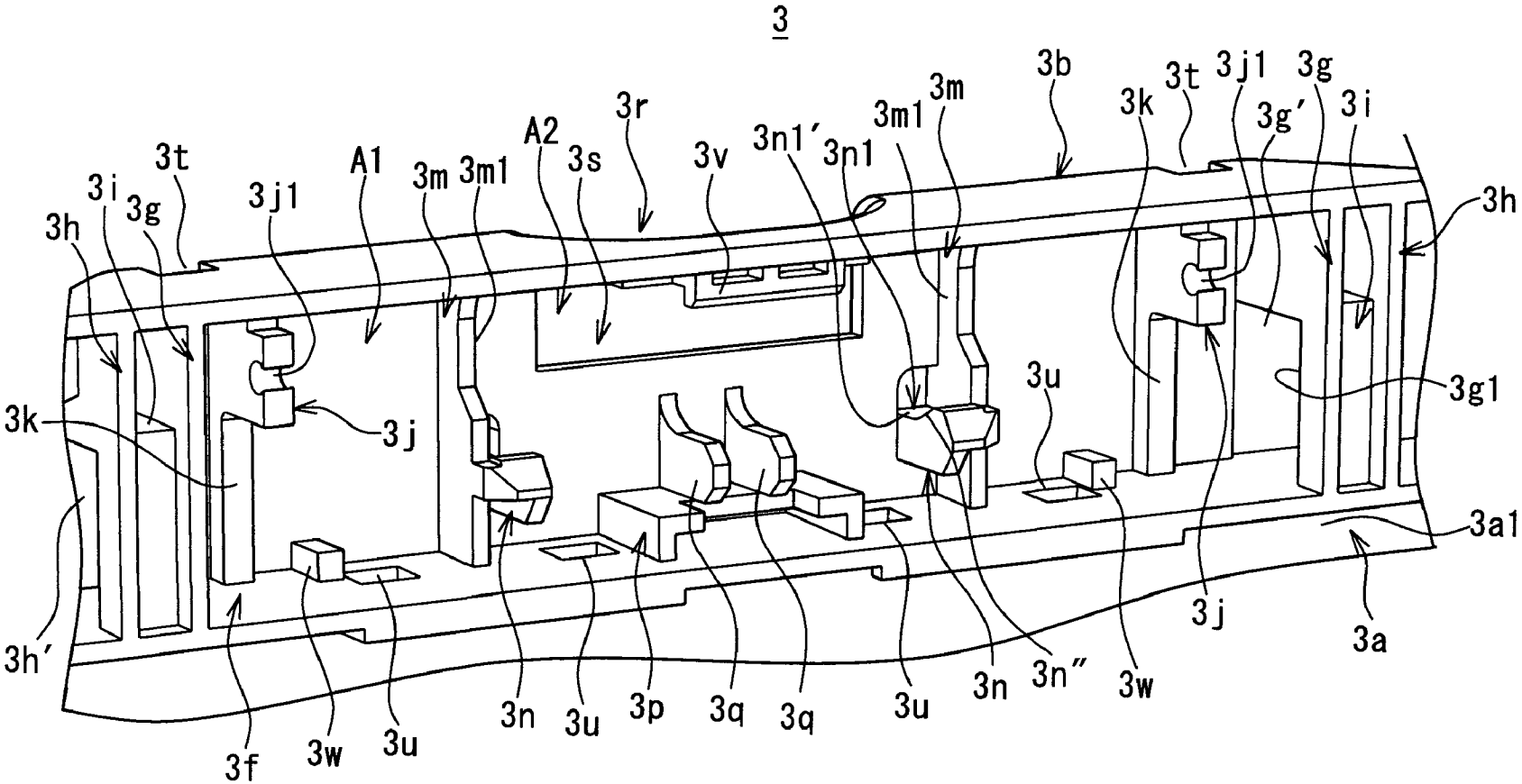
FIG. 6 is a partly enlarged perspective view of the short side wall shown in FIG. 4.
Figure 7:
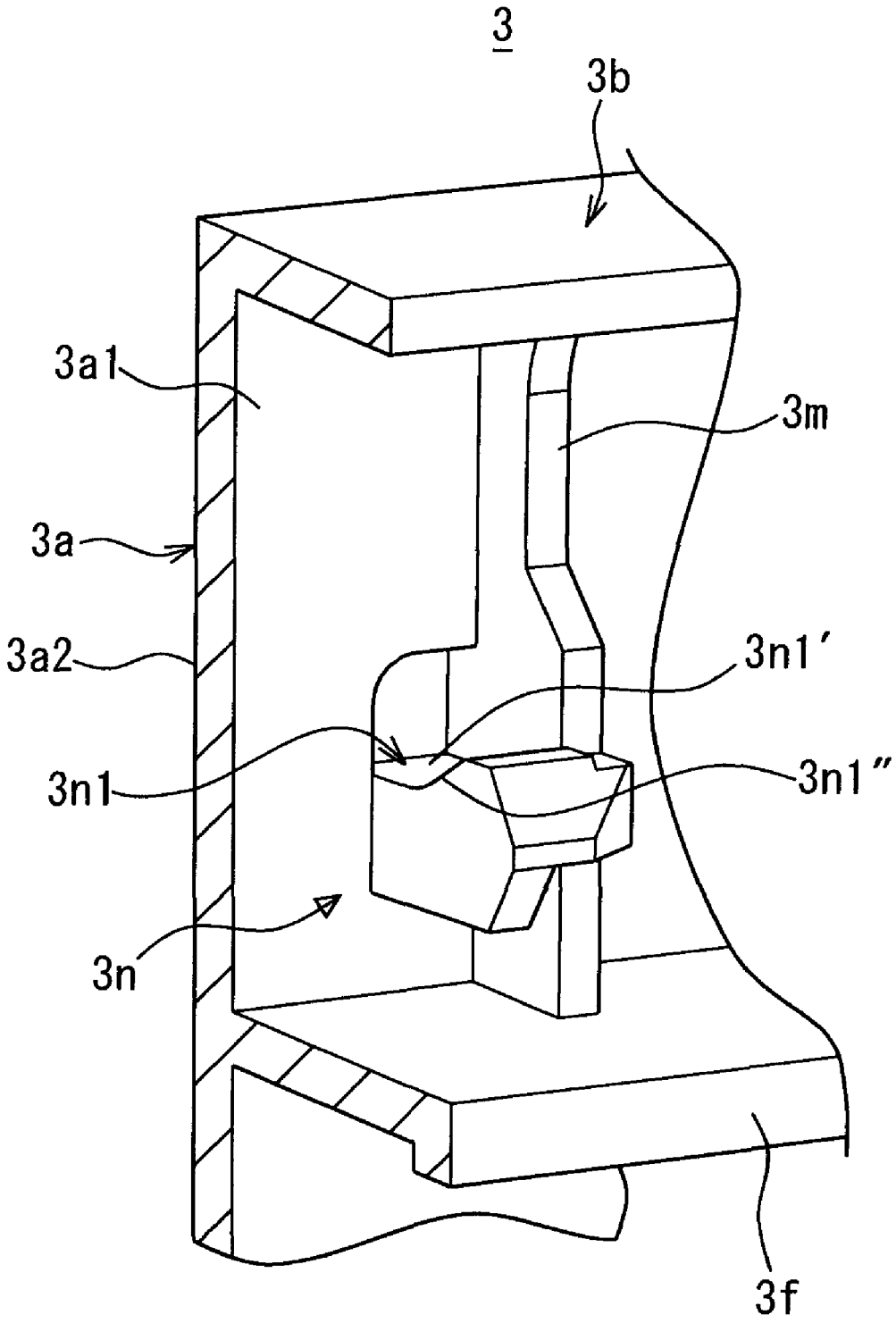
FIG. 7 is also a partly enlarged perspective view of the short side wall shown in FIG. 4.
Figure 8:
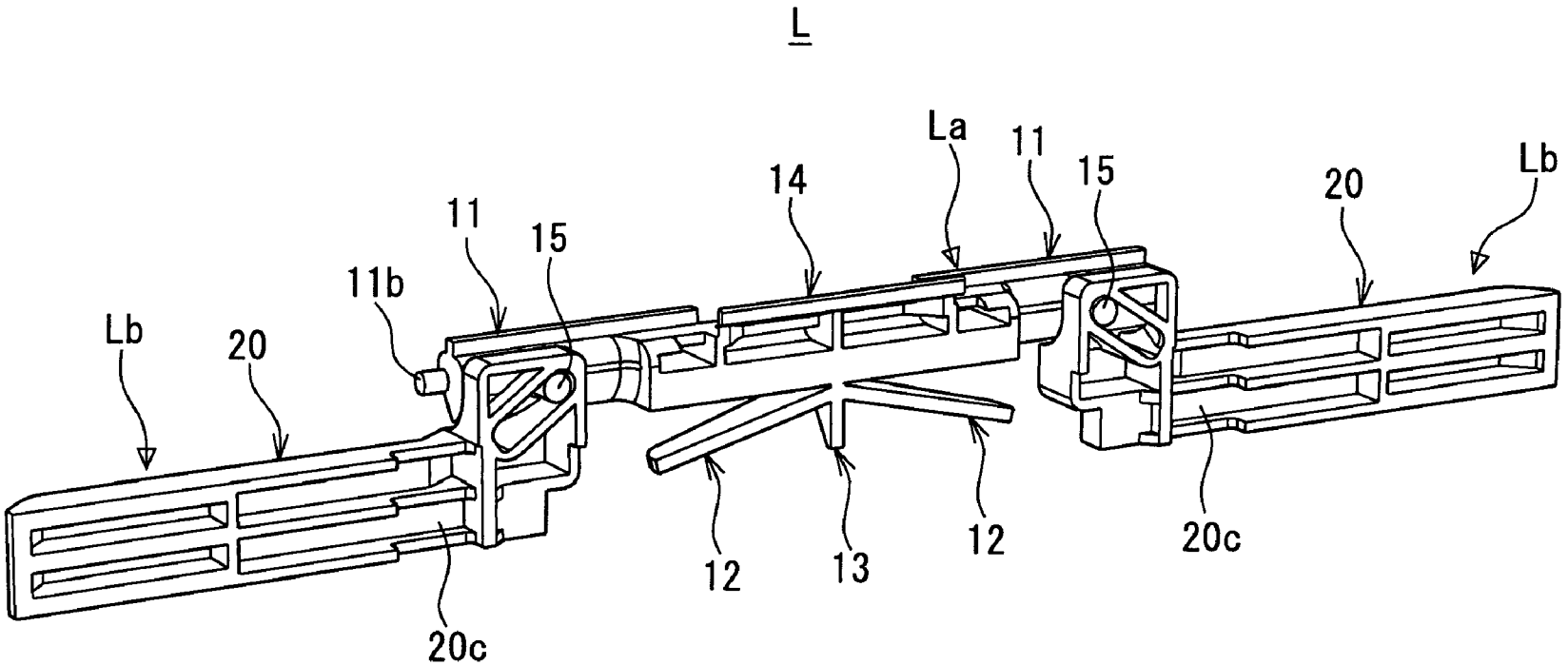
FIG. 8 is a perspective view of a lock member included in the folding container according to the present invention.
Figure 9:
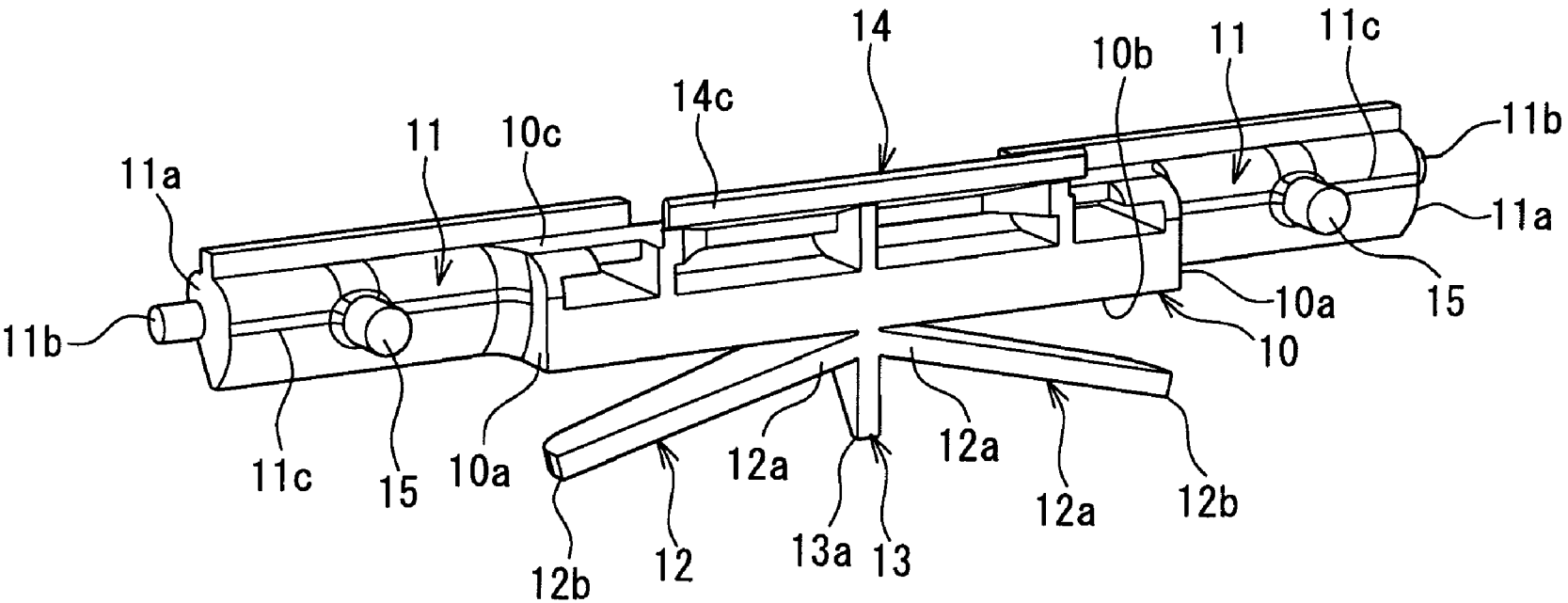
FIG. 9 is a perspective view of an operation member included in the lock member of the folding container according to the present invention.
Figure 10:
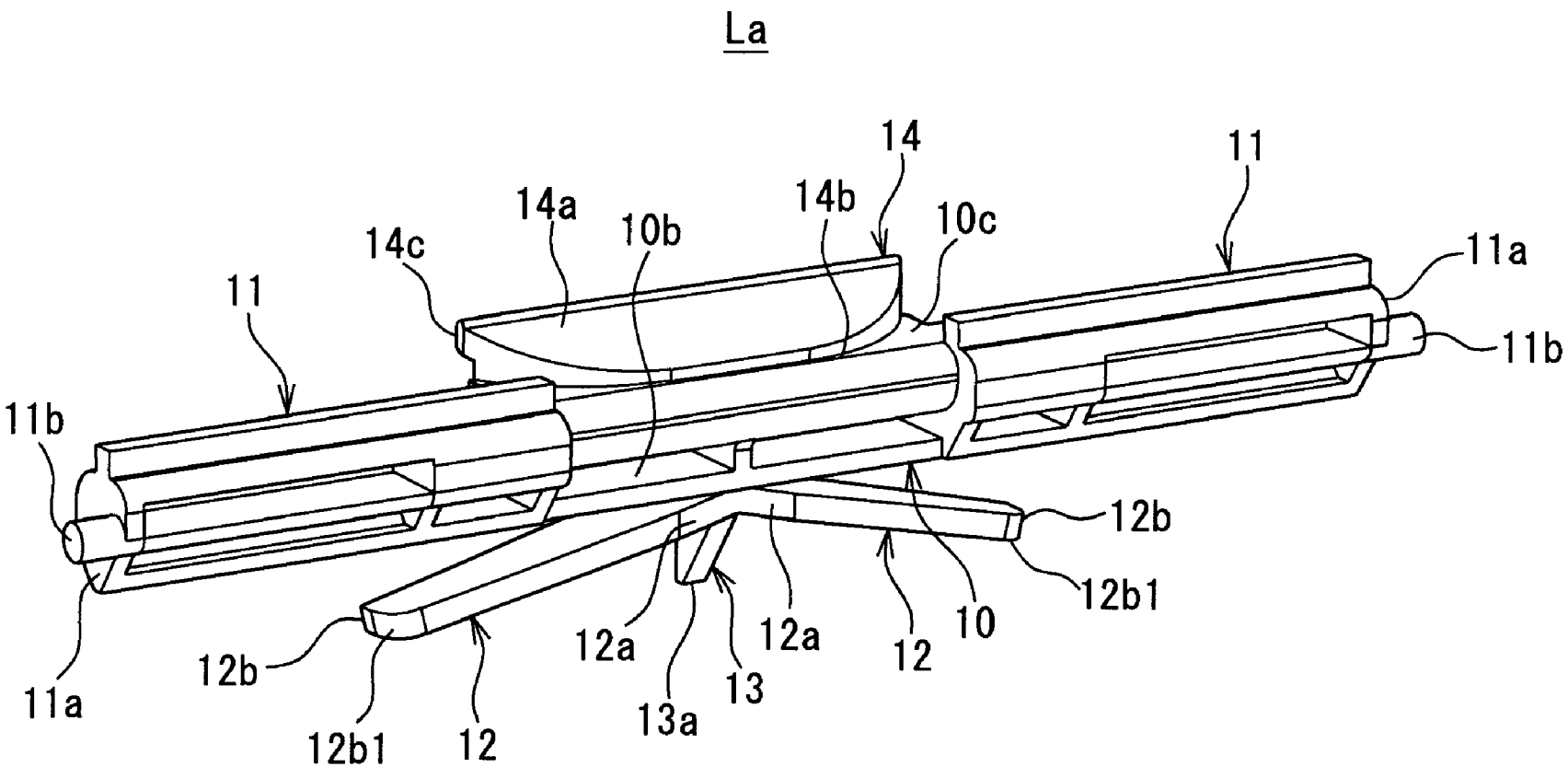
FIG. 10 is also a perspective view of the operation portion included in the lock member of the folding container according to the present invention.
Figure 11:
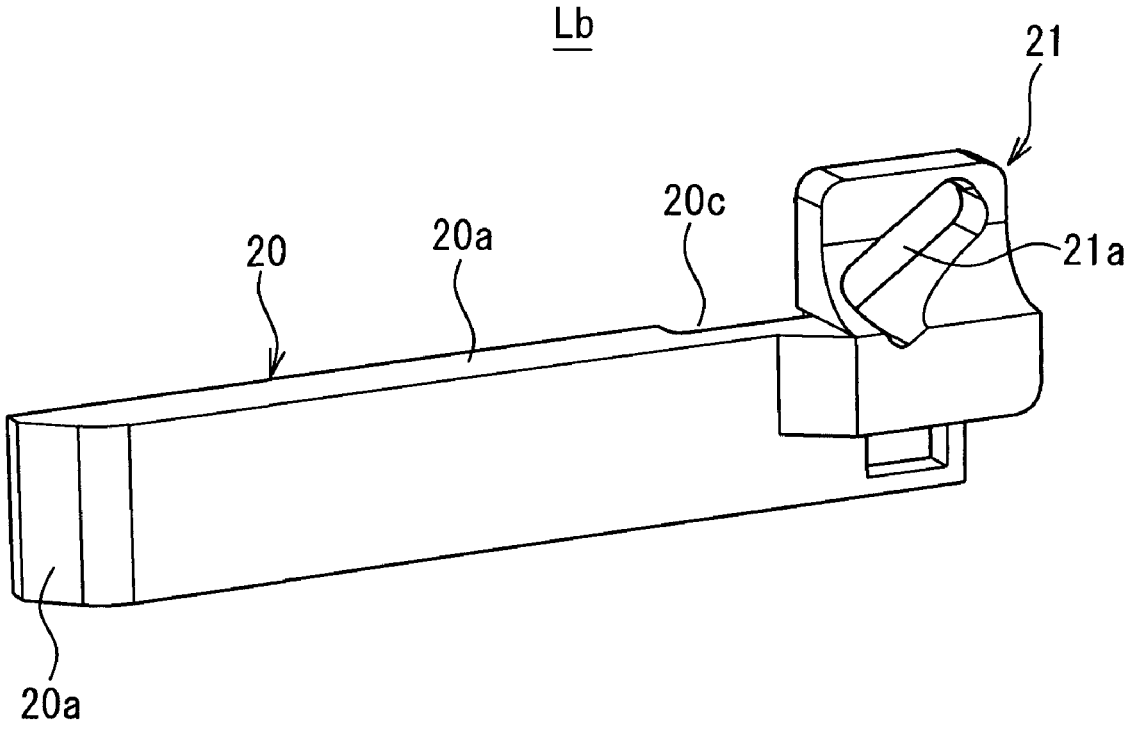
FIG. 11 is a perspective view of a lock bar included in the lock member of the folding container according to the present invention.

Now, the long side wall 2 will be described with reference to FIGS. 1 to 3.

The long side wall 2 has a square plate-like portion 2*a*. An upper-end horizontal flange 2*b* is formed at the upper end of the long side wall 2. Furthermore, a vertically long, long side wall-side engaging member 2*c* is formed at each of opposite vertical ends of the long side wall 2; the long side wall-side engaging member 2*c* is perpendicular to the plate-like portion 2*a* and to the inner surface (the surface which, when the folding container is assembled into the box form, is positioned inside the folding container assembled into the box form) 2*a*1 of the plate-like portion 2*a*. An engaging recess portion 2*d* that is open toward the opposite long side wall 2 is formed at the upper end of a corner portion formed by the inner surface 2*a*1 of the plate-like portion 2*a* and a vertically long band-like plate (hereinafter referred to as a terminal vertically-long band-like plate) 2*c*1 included in the long wall-side engaging member 2*c* and which is perpendicular to the inner surface 2*a*1 of the plate-like portion 2*a*. The engaging recess portion 2*d* is surrounded by the terminal vertically long band-like plate 2*c*1, a vertical side wall 2*d*1 that is parallel to the terminal vertically long band-like plate 2*c*1, a top plate 2*d*2 coupling the upper end of the vertical side wall 2*d*1 to the terminal vertically long band-like plate 2c1, a bottom plate 2d3 coupling the lower end of the vertical side wall 2d1 and the terminal vertically long band-like plate 2c1 together, and the plate-like portion 2a. Furthermore, an upper-end fitting hole 2e1 is formed at the upper end of the above-described terminal vertically long band-like plate 2c1. Additionally, an appropriate number of fitting holes 2e2 are formed in the terminal vertically long band-like plate 2c1 positioned below the upper-end fitting hole 2e1. In the example in the present embodiment, two fitting holes 2e2 are formed.

Now, the short side wall 3 will be described with reference to FIGS. 4 to 7.

The short side wall 3 has a long plate-like portion 3a. An upper-end horizontal flange 3b is formed at the upper end of the short side wall 3. A vertically long, terminal vertical rib 3c is formed at each of vertical ends of the short side wall 3 perpendicularly to the plate-like portion 3a so as to extend toward the outer surface (the surface which, when the folding container is assembled into the box form, is positioned outside the folding container assembled into the box form) 3a1 of the plate-like portion 3a.

Outside the terminal vertical rib 3c, a vertically long, short side wall-side engaging member 3d is extended along the plate-like portion 3a. An upper-end fitting projecting portion 3e1 that is perpendicular to the plate-like portion 3a is formed at the upper end of the short side wall-side engaging member 3d. Furthermore, an appropriate number of fitting projecting potions 3e2 are formed below the upper-end fitting projecting portion 3e1.

As shown in FIG. 1, when the folding container is in the assembled box form, the upper-end fitting projecting portion 3e1 formed at the upper end of the short side wall-side engaging member 3d of the short side wall 3 is fitted in the upper-end fitting hole 2e1 formed at the upper end of the long side wall-side engaging member 2c of the long side wall 2. Furthermore, the fitting projecting portions 3e2 formed on the short side wall-side engaging member 3d of the short side wall 3 are fitted in the fitting holes 2e2 formed in the respective long side wall-side engaging member 2c of the long side wall 2.

An upper horizontal rib 3f is formed in the upper portion of the outer surface 3a1 of the plate-like portion 3a forming the short side wall 3 and at a predetermined distance from the upper-end horizontal flange 3b, so as to extend to the terminal vertical ribs 3c. The upper-end horizontal flange 3b and the upper horizontal rib 3f are coupled together via upper vertical portions 3c2 of the terminal vertical rib 3c each extending in the vertical direction via upper horizontal portions 3c1 of the terminal vertical rib 3c. Furthermore, paired opposite central coupling vertical ribs 3g arranged at a predetermined distance from each other is formed so as to couple a central area of the upper-end horizontal flange 3b to a central area of the upper horizontal rib 3f. Terminal-side coupling vertical ribs 3h are each formed on the terminal vertical rib 3c side of the central coupling vertical rib 3g, with a predetermined gap between the central coupling vertical rib 3g and the terminal-side coupling vertical ribs 3h. Moreover, a vertically long coupling block 3i is formed in the gap between the central coupling vertical rib 3g and the terminal-side coupling vertical rib 3h to couple the central coupling vertical rib 3g to the terminal-side coupling vertical rib 3h. The terminal-side coupling vertical rib 3h and the vertically long coupling block 3i may be appropriately omitted. Furthermore, a coupling vertical rib may be additionally provided between the upper-end vertical portion 3c2 of the terminal vertical rib 3c and the central coupling vertical rib 3g to couple the upper-end horizontal flange 3b to the upper horizontal rib 3f.

A central space portion A1 covered by a cover member 4 described below is formed by the upper upper-end horizontal flange 3b, the upper horizontal rib 3f, the paired opposite central coupling vertical ribs 3g, and the outer surface 3a1 of the plate-like portion 3a, all described above.

A lock bar insertion hole through which a lock bark described below can be inserted is drilled in each of the vertical end wall 3d1 of the above-described short side wall-side engaging member 3d, the upper vertical portion 3c2 of the terminal vertical rib 3c, the terminal-side coupling vertical rib 3h, the vertically long coupling block 3i, and the central coupling vertical rib 3g so that the lock bar insertion holes communicate with one another as viewed from the vertical end wall 3d1 of the short side wall-side engaging member 3d. The lock bar insertion holes are composed of a lock bar insertion hole 3d1' drilled in the vertical end wall 3d1, a lock bar insertion hole 3c2' drilled in the upper vertical portion 3c2 of the terminal vertical rib 3c, a lock bar insertion hole 3h' drilled in the terminal-side coupling vertical rib 3h, a lock bar insertion hole (not shown in the drawings) drilled in the vertically long coupling block 3i, and a lock bar insertion hole 3g' drilled in the central coupling vertical rib 3g.

Paired pivotal shaft support blocks 3j extending perpendicularly to the outer surface 3a1 of the plate-like portion 3a are formed on a part of the plate-like portion 3a positioned in the central space portion A1 and close to the upper-end horizontal flange 3b. A fitting recess portion 3j1 is formed in each of the pivotal shaft support blocks 3j. 3k is a vertical reinforcing rib formed on the plate-like portion 3a so as to couple the pivotal shaft support block 3j to the upper horizontal rib 3f.

Paired spring receiving and supporting vertical ribs 3m are each formed at a position closer to the center of the plate-like portion 3a than the pivotal shaft support block 3j, so as to couple the upper-end horizontal flange 3b to the upper horizontal rib 3f. A spring receiving support block 3n is formed below a corner formed by the corresponding one of the opposite side surfaces 3m1 of the paired spring receiving and supporting vertical ribs 3m and the outer surface 3a1 of the plate-like portion 3a. Furthermore, the tip of the spring receiving support block 3n is formed to project from the tip of the spring receiving and supporting vertical rib 3m. Additionally, the top surface 3n1 of the spring receiving support block 3n is formed by a horizontal surface 3n1' extending from the outer surface 3a1 of the plate-like portion 3a and an inclined surface 3n1" extending upward from an end of the horizontal surface 3n1'.

A pedestal 3p is formed in a corner formed by the outer surface 3a1 of the plate-like portion 3a and a portion of the top surface of the upper horizontal rib 3f which is positioned on a central portion between the paired opposite spring receiving and supporting vertical ribs 3m. Paired guiding and reinforcing vertical pieces 3q are formed in a corner formed by the top surface of the pedestal 3p and the outer surface 3a1 of the plate-like portion 3a; the guiding and reinforcing vertical pieces 3q are formed upright on the pedestal 3p with a predetermined gap between the vertical pieces 3q.

A recess portion 3r with a circular arc-like planar shape is formed in a central portion of the upper-end horizontal flange 3b so as to extend from the inner surface (the surface which, when the folding container is assembled into the box form, is positioned inside the folding container assembled into the box form) 3a2 of the plate-like portion 3a toward the outer surface 3a1 of the plate-like portion 3a. A horizontally long, rectangular through-hole 3s communicating with the circular arc-like recess portion 3r is drilled in a part of the plate-like portion 3a at which the circular arc-like recess portion 3r is positioned. The circular arc-like recess portion 3r and the rectangular through-hole 3*s* form an operation portion inserting space portion A2 in a central portion of the inner upper corner portion of the short side wall 3 of the folding container assembled in the box form.

Cutout through-holes 3*t* are formed near the respective opposite ends of a corner portion formed by the upper-end horizontal flange 3*b* and the plate-like portion 3*a*. Furthermore, an appropriate number of locking through-holes 3*u* are drilled in the upper horizontal rib 3*f* positioned in the central space portion A1. In the present embodiment, by way of example, four engaging through-holes 3*u* are drilled. Moreover, an elastically deformable, elastic locking piece 3*v* that is perpendicular to the upper-end horizontal flange 3*b* hangs from a portion of the bottom surface of the upper-end horizontal flange 3*b* which portion is positioned in a central portion of the rectangular through-hole 3*s* formed in the plate-like portion 3*a* included in the operation portion inserting space portion A2. An appropriate number of lock bar bottom-surface support blocks 3*w* are formed on the top surface of the upper horizontal rib 3*f* to guide and support the bottom surface of a lock bar described below. In the present embodiment, by way of example, two lock bar bottom-surface support blocks 3*w* are formed.

Now, a lock member L composed of one operation portion La and paired lock bars Lb will be described with reference to FIGS. 8 to 11.

The operation portion La has a horizontally long, substantially prismatic operation main body 10 and two horizontal arms 11 formed on the respective opposite vertical side surfaces 10*a* of the operation main body 10. Furthermore, a pivotal shaft 11*b* is formed on the tip vertical surface 11*a* of each of the horizontal arms 11. Moreover, paired flat-plate-like inclined spring members 12 are formed in a central portion of the bottom horizontal plate portion 10*b* of the operation main body 10, and extend along the longitudinal direction of the operation main body 10 in opposite directions. Furthermore, an inclined spring member protect piece 13 is formed perpendicularly to the bottom horizontal plate portion 10*b* of the operation main body 10, on a part of the bottom horizontal plate portion 10*b* of the operation main body 10 which part is positioned in a central portion between root portions 12*a* of the paired inclined spring members 12.

The vertical distance between the lower end 13*a* of the inclined spring member protect piece 13 and the bottom surface of the bottom horizontal plate 10*b* is substantially the same as that between the tip portion 12*b* of the inclined spring member protect piece 12 and the bottom surface of the bottom horizontal plate portion 10*b*. In other words, the lower end 13*a* of the inclined spring member protect piece 13 and the tip portion 12*b* of the inclined spring member 12 are positioned on substantially the same horizontal plane. In this configuration, the operation portion La, which is a part accommodated in the box, comes into abutting contact with the side wall and the like of the box. Thus, even when the paired inclined spring members 12 start to tilt excessively, the inclined spring member protect piece 13 comes into abutting contact with the side wall and the like of the box to allow the inclined spring members 12 to be prevented from being excessively deformed. Consequently, the inclined spring members 12 can be prevented from being damaged. The inclined spring member protect piece 13 may be omitted.

14 is a circular-arc operation portion formed on the top surface of an upper horizontal plate portion 10*c* of the operation main body 10. The top surface 14*a* of the operation portion 14 is inclined upward with respect to the top surface of the upper horizontal plate portion 10*c* of the operation main body 10. Furthermore, a circular arc operation portion 14*b* of the operation portion 14 is positioned on the operation main body 10 side. A linear portion 14*c* of the operation portion 14 is positioned away from the operation main body 10. Additionally, a driven pin 15 extending perpendicularly to the side surface portion 11*c* is projected from a side surface portion 11*c* of each of the paired horizontal arms 11 which is located on the linear portion 14*c* side.

The lock bar Lb has a horizontal bar-like member 20, and a cam plate 21 provided upright at one end of the top surface 20*a* of the bar-like member 20 and in which an inclined cam groove 21*a* is drilled. Furthermore, an inclined surface 20*b* is formed at the tip portion of the bar-like member 20 which portion is positioned opposite the square cam plate 21. Moreover, the inclined cam groove 21*a* drilled in the cam plate 21 is formed so as to incline upward and away from the top surface 20*a* of the bar-like member 20. A recess portion 20*c* that does not hinder horizontal movement of the lock bar Lb is formed in one of the side surfaces of the bar-like member 20 which is positioned near the cam plate 21; a vertical reinforcing rib 3*k* formed to couple the pivotal shaft support block 3*j* and upper horizontal rib 3*f* described above is inserted into the recess portion 20*c*.

Figure 12:
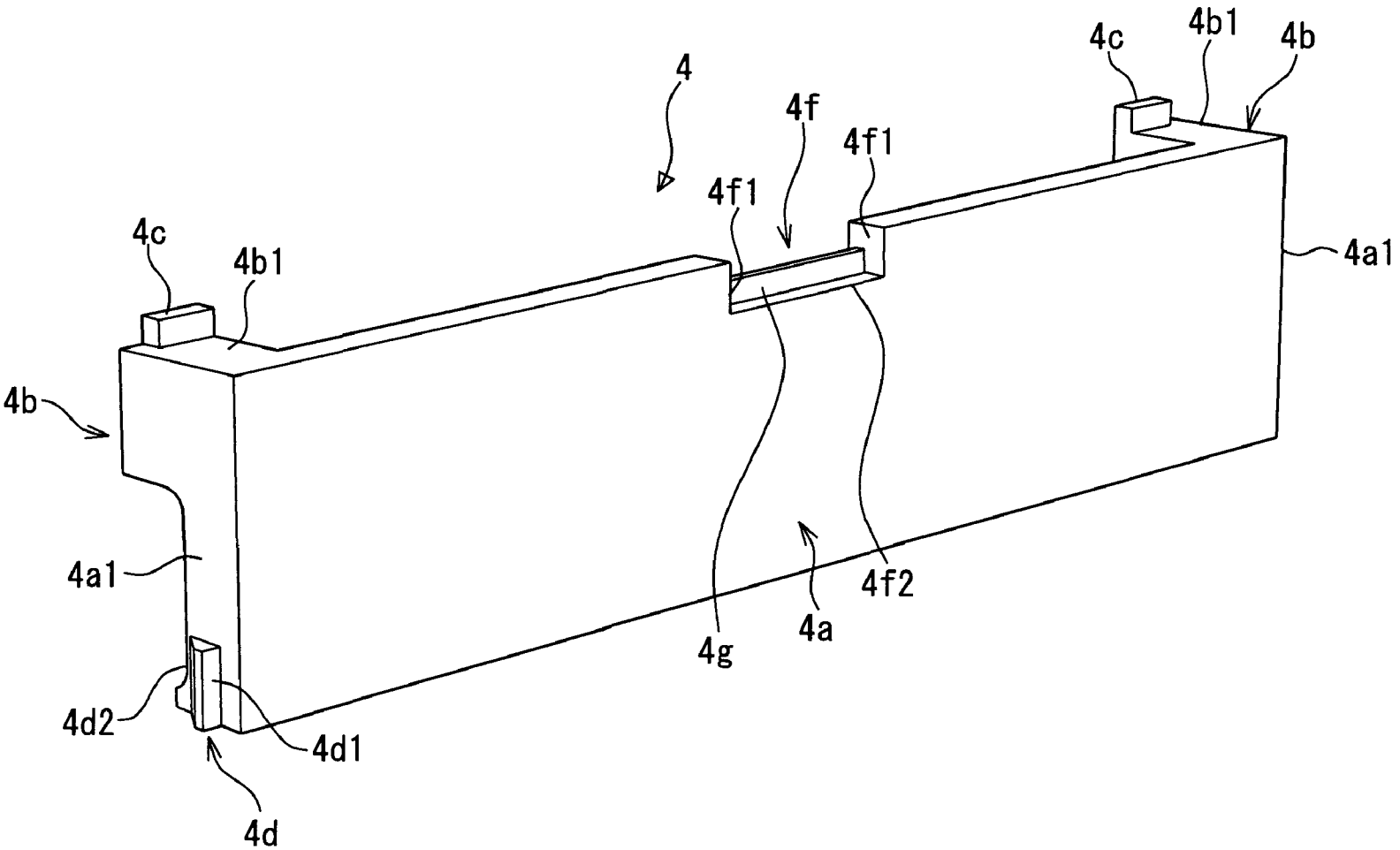
FIG. 12 is a perspective view of a cover member included in the folding container according to the present invention.
Figure 13:
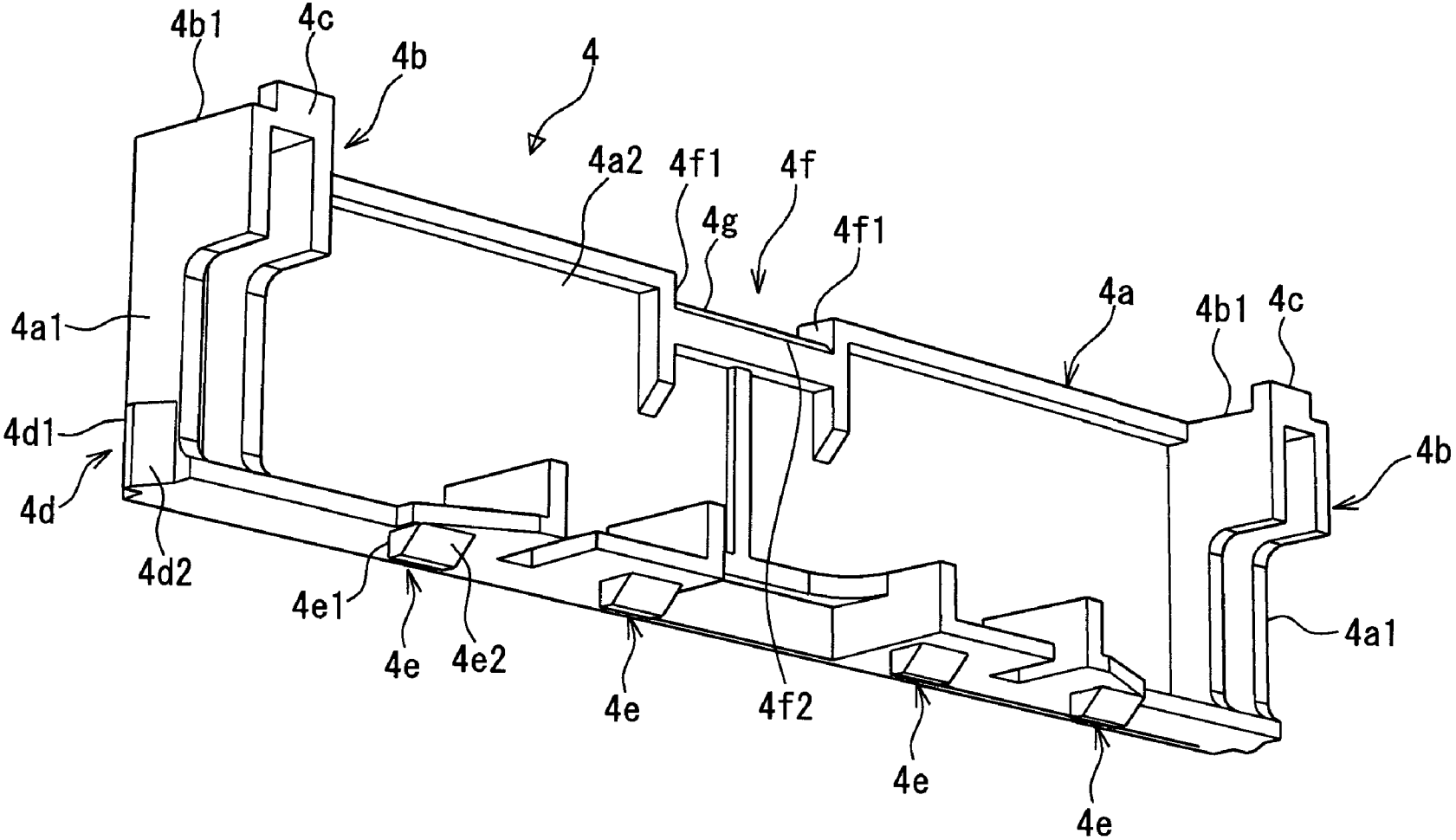
FIG. 13 is a perspective view of the cover member included in the folding container according to the present invention.

Now, the cover member 4 will be described with reference to FIGS. 12 and 13.

The cover member 4 has a main body portion 4*a* formed like a horizontally long plate and upper-end block portions 4*b* each extending from the upper end of the main body portion 4*a* perpendicularly to the main body portion 4*a*. An insertion piece 4*c* is provided upright at the tip portion of the top surface 4*b*1 of the upper-end block portion 4*b* and inserted into a corresponding one of the cutout through-holes 3*t* formed at the respective opposite ends of the corner portion formed by the upper-end horizontal flange 3*b* and plate-like portion 3*a* of the short side wall 3. Furthermore, a triangular, vertical projecting portion 4*d* is formed at the lower end of each of opposite vertical side surfaces 4*a*1 of the main body portion 4*a* and can be hooked on a vertical inner edge 3*g*1 positioned on the lock bar insertion hole 3*g*' drilled in the corresponding central coupling vertical rib 3*g*. The triangular, vertical projecting portion 4*d* has a vertical side surface 4*d*1 perpendicular to the vertical side surface 4*a*1 of the main body portion 4*a* and a vertical inclined surface 4*d*2 inclining from the vertical tip of the vertical side surface 4*d*1 toward the vertical side surface 4*a*1 of the main body portion 4*a*. The vertical inclined surface 4*d*2 is positioned on the upper-end block portion 4*b* side.

Furthermore, triangular pyramid-like horizontal projecting portions 4*e* hang from the bottom surface of the main body portion 4*a* and are fitted into the locking through-holes 3*u* drilled in a portion of the upper horizontal rib 3*f* of the short side wall 3 which is positioned inside the central space portion A1 formed in the short side wall 3. The triangular pyramid-like horizontal projecting portion 4*e* has a horizontal perpendicular surface 4*e*1 that is perpendicular to the main body portion 4*a* and a horizontal inclined surface 4*e*2 inclining from the bottom surface of the main body portion 4*a* toward the horizontal perpendicular surface 4*e*1.

Moreover, a recess portion 4*f* composed of opposite side surfaces 4*f*1 and a bottom surface 4*f*2 is formed in a central portion of the top surface of the main body portion 4*a*. An engaging vertical piece 4*g* bridging the opposite side surfaces 4*f*1 is formed on the bottom surface 4*f*2 of the recess portion 4*f*. An elastically deformable elastic locking piece 3*v* hanging from the rear surface of the upper-end horizontal flange 3*b* of the short side wall 3 is locked on the engaging vertical piece 4*g*.

Figure 14:
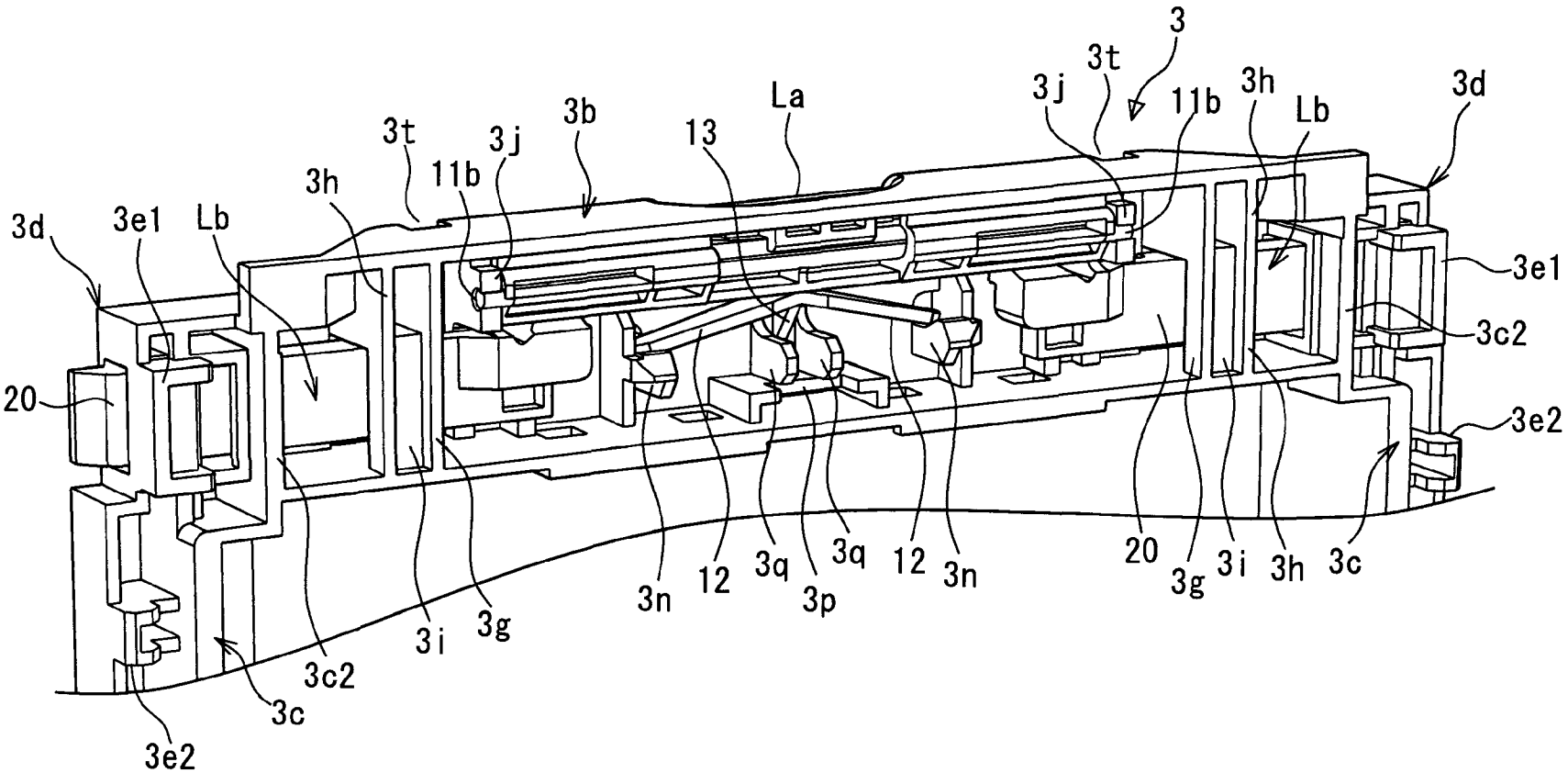
FIG. 14 is a partial perspective view showing that the lock member included in the folding container according to the present invention is attached to the short side wall.

Now, attachment of the lock member L to the short side wall 3 will be described mainly with reference to FIG. 14.

First, the tip portion of the bar-like member 20 of each of the paired lock bars Lb is inserted from the central space potion A1 side through the lock bar insertion hole 3*g*' drilled in the central coupling vertical rib 3*g*, the lock bar insertion hole drilled in the vertically long coupling block 3*i*, the lock bar insertion hole 3*h*' drilled in the terminal-side coupling vertical rib 3*h*, the lock bar insertion hole 3*c*2' drilled in the upper vertical portion 3*c*2 of the terminal vertical rib 3*c*, and the lock bar insertion hole 3*d*1' drilled in the vertical end wall 3*d*1 of the short side wall engaging member 3*d*, in this order. Thus, the cam plate 21 formed on the lock bar Lb comes into abutting contact with the central coupling vertical rib 3*g* formed in the central space portion A1 of the short side wall 3 or is positioned close to the central coupling vertical rib 3*g*. In this case, the inclined surface 20*b* formed at the tip portion of the bar-like member 20 is positioned on the outer surface 3*a*1 side of the plate-like portion 3*a* of the short side wall 3.

Then, the operation portion La is moved closer to a portion of the outer surface 3*a*1 of the plate-like portion 3*a* of the short side wall 3 which portion is positioned in the central space portion A1. Thus, the pivotal shaft 11*b* formed in the tip vertical surface 11*a* of each of the horizontal arms 11 of the operation portion La is fitted into the fitting recess portion 3*j*1 of the corresponding pivotal shaft support block 3*j* formed on a part of the plate-like portion 3*a* positioned in the central space portion A1 of the short side wall 3 and near the upper-end horizontal flange 3*b*. Furthermore, the driven pin 15 formed on the horizontal arm 11 is inserted through the inclined cam groove 21*a* drilled in the cam plate 21 of the lock bar Lb. Additionally, the operation portion 14 formed in the operation main body 10 is inserted into the operation portion inserting space portion A2 formed so as to stride over the central portion of the upper-end horizontal flange 3*b* and the plate-like portion 3*a* of the short side wall 3. Moreover, the tip portion 12*b* of each of the inclined spring members 12 formed on the central portion of the bottom surface of the operation main body 10 of the operation portion La is placed on the horizontal surface 2*n*1' forming the top surface 3*n*1 of the corresponding spring receiving support block 3*n* formed in the central space portion A1 of the short side wall 3.

As described above, when the operation portion 14 formed on the operation main body 10 of the operation portion La included in the lock member L is inserted into the operation portion inserting space portion A2, the linear portion 14*c* of the operation portion 14 becomes substantially flush with the inner surface 3*a*2 of the short side wall 3. Furthermore, the inclined spring member protect piece 13 hanging from the bottom surface of the bottom horizontal plate portion 10*b* of operation main body 10 included in the operation portion La is located between the paired guiding and reinforcing vertical pieces 3*q*.

Furthermore, when the lock member L is attached to the short side wall 3, the tip portion of the bar-like member 20 of the lock bar Lb projects from the vertical side wall 3*d*1 of the corresponding short side wall engaging member 3*d*. Furthermore, the tip portion 12*b* of each of the inclined spring members 12 formed on the central portion of the bottom surface of the operation main body 10 of the operation portion La is placed on the horizontal surface 3*n*1' forming the top surface 3*n*1 of the corresponding spring receiving support block 3*n* formed in the central space portion A1 of the short side wall 3. Moreover, the driven pin 15 formed on the horizontal arm 11 of the operation portion La is positioned near the upper end of the inclined cam groove 21*a* drilled in the cam plate 21 of the lock bar Lb.

Moreover, when the lock member L is attached to the short side wall 3 as described above, the circular arc operation portion 14 formed on the operation main body 10 of the lock member L is fitted into the operation portion inserting space portion A2 formed in the central portion of the inner upper corner portion of the short side wall 3 of the folding container assembled in a box form.

Then, the main body portion 4*a* of the cover member 4 is placed opposite a part of the outer surface 3*a*1 of the plate-like portion 3*a* which part is positioned in the central space portion A1 formed in the short side wall 3. Thereafter, the cover member 4 is moved closer to the short side wall 3 to insert the insertion pieces 4*c* projected from the top surface 4*b*1 of the upper-end block portion 4*b* into the respective cutout through-holes 3*t* formed near the corresponding opposite ends of the corner portion formed by the upper-end horizontal flange 3*b* and plate-like portion 3*a* of the short side wall 3. Furthermore, the triangular prism-like vertical projecting potion 4*d* projected from the lower end of each of the opposite vertical side surfaces 4*a*1 of the main body portion 4*a* included in the cover member 4 is hooked on the inner edge 3*g*1 positioned on the side of the lock bar insertion hole 3*g*' drilled in each of the central coupling vertical ribs 3*g* formed on the short side wall 3. Moreover, the triangular prism-like horizontal projecting portion 4*e* hanging from the bottom surface of the main body portion 4*a* included in the cover member 4 is fitted into the locking through-hole 3*u* drilled in the upper horizontal rib 3*f* positioned in the central space portion A1 of the short side wall 3. Additionally, the engaging vertical piece 4*g* bridging the opposite side surfaces 4*f*1 of the recess portion 4*f* formed in the central portion of the top surface of the main body portion 4*a* included in the cover member 4 is locked on the elastic locking piece 3*v* hanging from the rear surface of the upper-end horizontal flange 3*b* of the short side wall 3. Thus, the central space portion A1 formed in the short side wall 3 is covered with the cover member 4.

Figure 15:
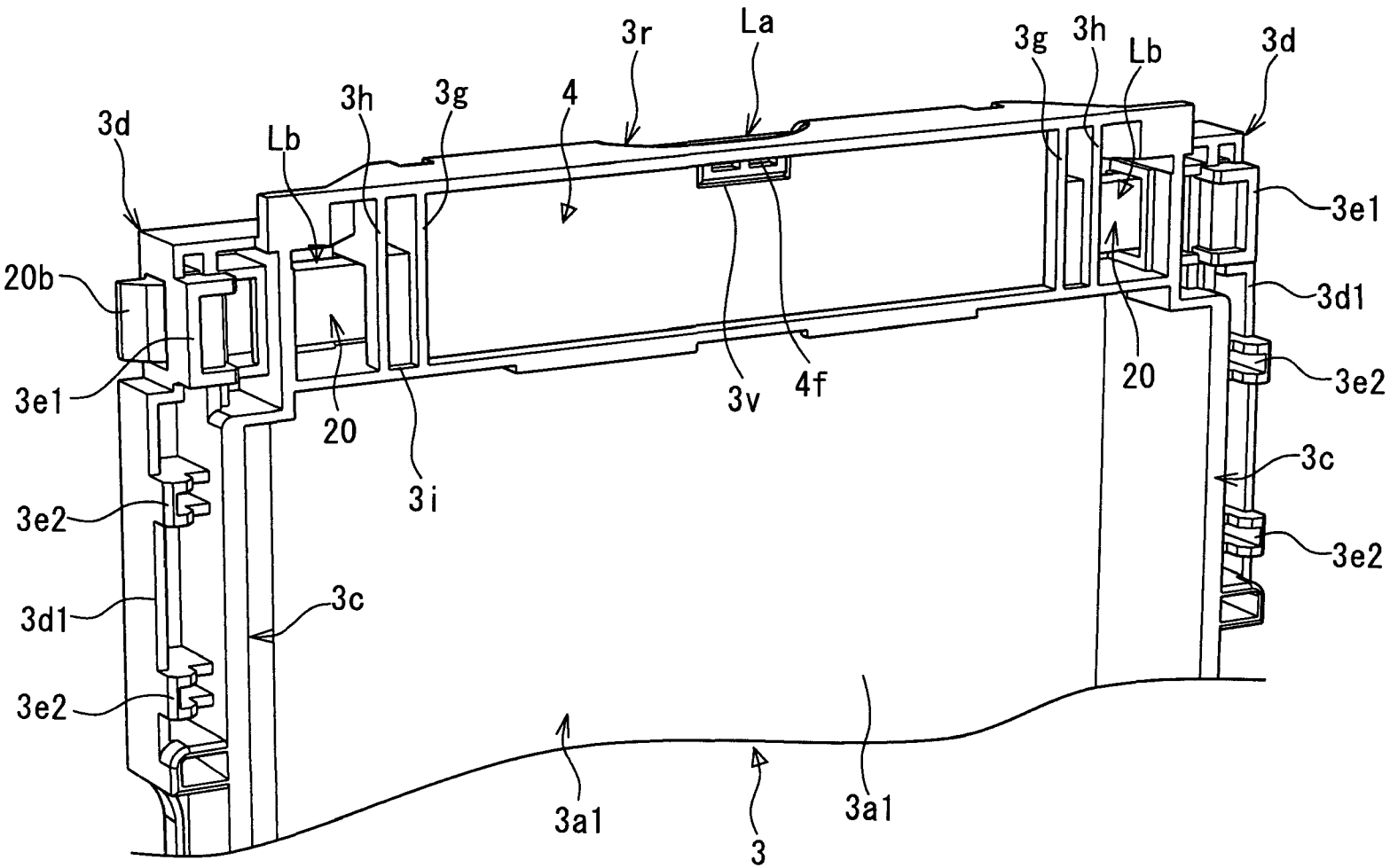
FIG. 15 is a partial perspective view showing that the cover member included in the folding container according to the present invention is attached to the short side wall.

In the step of covering the central space portion A1 formed in the short side wall 3, with the cover member 4 as described above, the following are placed on the outer surface 3*a*1 side of the plate-like portion 3*a* forming the short side wall 3: the vertical inclined surface 4*d*2 formed on the triangular prism-like vertical projecting portion 4*d* projected from the lower end of each of the opposite vertical side surfaces 4*a*1 of the main body portion 4*a*, and the horizontal inclined surface 4*e*2 of each of the triangular prism-like horizontal projecting portions 4*e* hanging from the bottom surface of the main body portion 4*a*. In this state, the cover member 4 is moved closer to the short side wall 3. Then, the vertical inclined surface 4*d*2 formed on the triangular prism-like vertical projecting portion 4*d* projected from the lower end of each of the opposite vertical side surfaces 4*a*1 of the main body portion 4*a* comes into abutting contact with the corresponding central coupling vertical rib 3*g* formed in the central space portion A1 formed in the short side wall 3 to allow the triangular prism-like vertical projecting portion 4*d* to be guided via the vertical inclined surface 4*d*2. This facilitates installation of the cover member 4 over the central space portion A1. Similarly, the horizontal inclined surface 4*e*2 of each of the triangular prism-like horizontal projecting portions 4*e* hanging from the bottom surface of the main body portion 4*a* included in the cover member 4 comes into abutting contact with the tip of the upper horizontal rib 3*f* of the short side wall 3 to allow the triangular prism-like horizontal projecting portion 4*e* to be guided via the horizontal inclined surface 4*e*2. This facilitates installation of the cover member 4 over the central space portion A1. Thus, as shown in FIG. 15, the central space portion A1 formed in the short side wall 3 is covered with the cover member 4.

As described above, the central space portion A1 formed in the short side wall 3 is covered with the cover member 4. Thus, the operation portion La and lock bar Lb forming the lock member L placed in the central space portion A1 formed over the short side wall 3 are prevented from being exposed to the exterior. Thus, the operation portion La and lock bar Lb forming the lock member L placed in the central space portion A1 can be prevented from being damaged by an external member. Furthermore, the cover member 4 serves to prevent the central space portion from being deformed under loads imposed from above in a stacked state. This also allows the operation portion La and lock bar Lb forming the lock member L to be prevented from being damaged.

To assemble the folded folding container into a box form as shown in FIG. 1, firstly, an operator pivotally moves each of the horizontally laid long side walls 2 in the vertical direction to setup the long side wall 2 vertically. Then, each of the horizontally laid short side walls 3 is pivotally moved in the vertical direction. During the step of pivotally moving the short side wall 3 in the vertical direction, the inclined surface 20*b* formed at the tip portion of the bar-like member 20 of the lock bar Lb included in the lock member L attached to the short side wall 3 comes into abutting contact with the vertical side wall 2*d*1 of the engaging recess portion 2*d* formed on the long side wall 2. In this state, the short side wall 3 is further pivotally moved in the vertical direction. Then, the inclined surface 20*b* formed at the tip portion of the bar-like member 20 of the lock bar Lb is guided along the vertical side wall 2*d*1 of the engaging recess portion 2*d* formed in the long side wall 2. At the same time, paired lock bars Lb move closer to each other in the horizontal direction. The tip portion of the bar-like member 20 of the lock bar Lb retracts from the vertical side wall portion 3*d*2 of the short side wall engaging member 3*d*. Thus, when the paired lock bars Lb move closer to each other in the horizontal direction, the driven pin 15 of the operation portion La positioned near the upper end of the inclined cam groove 21*a* drilled in the cam plate 21 of the lock bar Lb moves toward the lower end of the inclined cam groove 21*a*.

When the driven pin 15 moves toward the lower end of the inclined cam groove 21*a* as described above, the operation portion La pivotally moves downward using, as a pivotal support point, the pivotal shaft 11*b* of the operation portion La fitted in the fitting recess portion 3*j*1 of the pivotal shaft support block 3*j* formed in the central space portion A1 of the short side wall 3. Furthermore, the tip portion 12*b* of the inclined spring member 12 formed on the operation main body 10 of the operation portion La moves from the horizontal surface 3*n*1' forming the top surface 3*n*1 of the spring receiving support block 3*n* formed on the short side wall 3, toward the inclined surface 3*n*1". The tip portion 12*b* thus comes into abutting contact with the inclined surface 3*n*1". When the tip portion 12*b* of the inclined spring member 12 comes into abutting contact with the inclined surface 3*n*1" forming the top surface 3*n*1 of the spring receiving support block 3*n*, the tip portion 12*b* of the inclined spring member 12 is elastically deformed, against the elastic force of the inclined spring member 12, in the direction in which the tip portion 12*b* approaches the operation main body 10 of the operation portion La.

Thereafter, the inclined surface 20*b* formed at the tip portion of the bar-like member 20 of the lock bar Lb passes beyond the vertical side wall 2*d*1 of the engaging recess portion 2*d* formed in the long side wall 2. At this moment, because of the elastic restoring force of the inclined spring member 12 elastically deformed in the direction in which the inclined spring member 12 approaches the operation main body 10 of the operation portion La, the tip portion 12*b* of the inclined spring member 12 moves from the inclined surface 3*n*1" toward the horizontal surface 3*n*1', the inclined surfaces 3*n*" and the horizontal surface 3*n*1' forming the top surface 3*n*1 of the spring receiving support block 3*n* formed on the short side wall 3. The tip portion 12*b* of the inclined spring member 12 thus comes into abutting contact with the horizontal surface 3*n*1'. Consequently, the paired lock bars Lb move away from each other in the horizontal direction to insert the tip potion of the bar-like member 20 of the lock bar Lb into the engaging recess portion 2*d* formed in the long side wall 2.

Immediately before the tip portion of the bar-like member 20 of the lock bar Lb included in the lock member L attached to the above-described short side wall 3 is inserted into the engaging recess portion 2*d* formed in the long side wall 2, the upper-end fitting projecting portion 3*e*1 formed on the short side wall-side engaging member 3*d* of the short side wall 3 is fitted into the upper-end fitting hole 2*e*1 formed at the upper end of the long side wall-side engaging member 2*c* of the long side wall 2. Furthermore, the fitting projecting portion 3*e*2 formed on the short side wall-side engaging member 3*d* of the short side wall 3 is fitted into the fitting hole 2*e*2 formed in the long side wall-side engaging member 2*c* of the long side wall 2.

Simply by vertically setting up each of the horizontally laid long side walls 2 and then pivotally moving each of the horizontally laid short side walls 3 in the vertical direction, the operator can assemble the folded folding container into a box form as shown in FIG. 1 without the need to operate the lock member L attached to the short side wall 3.

Figure 16:
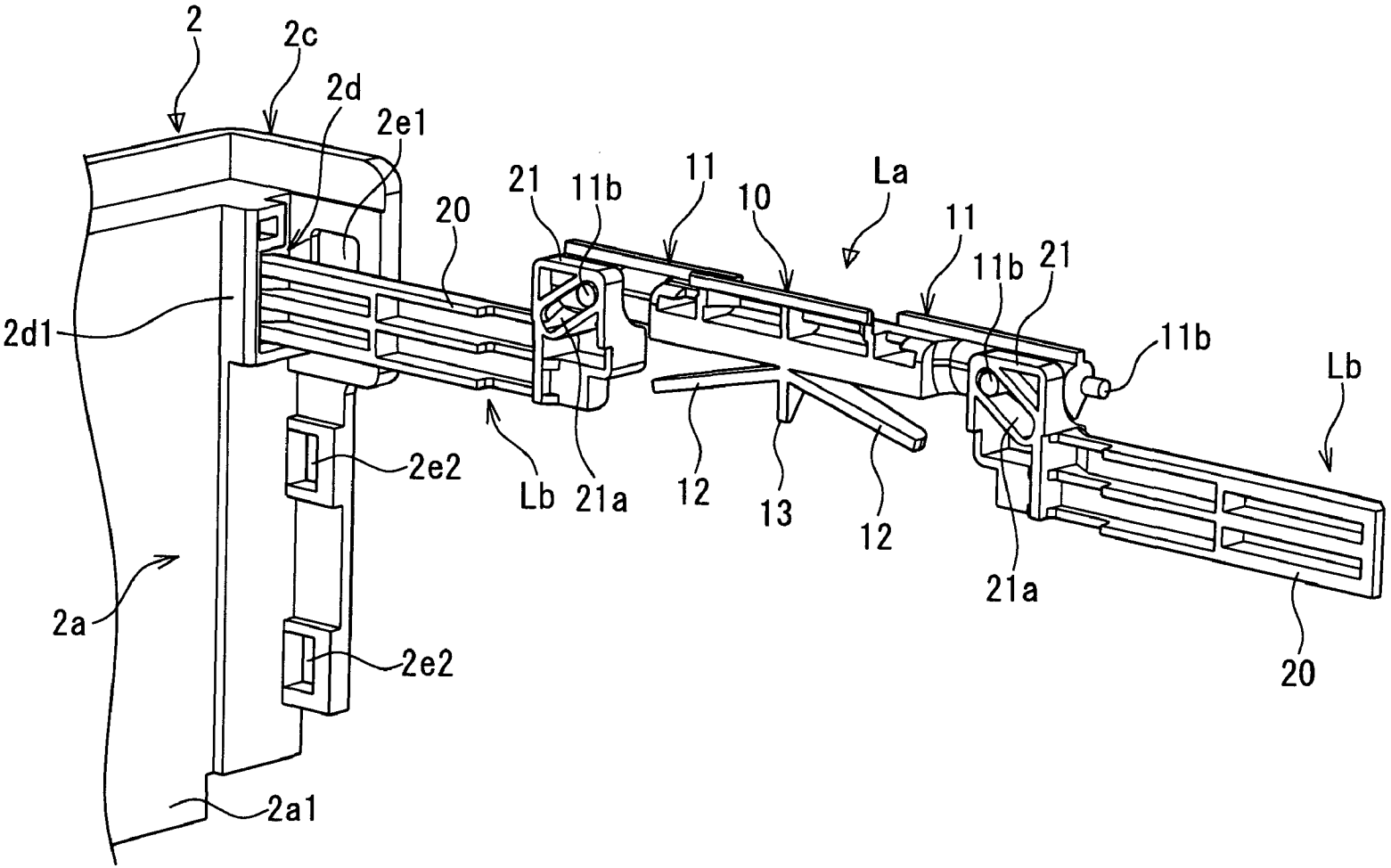
FIG. 16 is a partial perspective view showing the lock state of the folding container according to the present invention, with the short side wall omitted from the figure.

As described above, with the folding container assembled in the box form, the tip portion of the bar-like member 20 of the lock bar Lb included in the lock member L attached to the short side wall 3 is inserted into engaging recess portion 2*d* formed in the long side wall 2 as shown in FIG. 16. Thus, the short side wall 3 is prevented from falling down accidentally toward the bottom portion 1.

Figure 17:
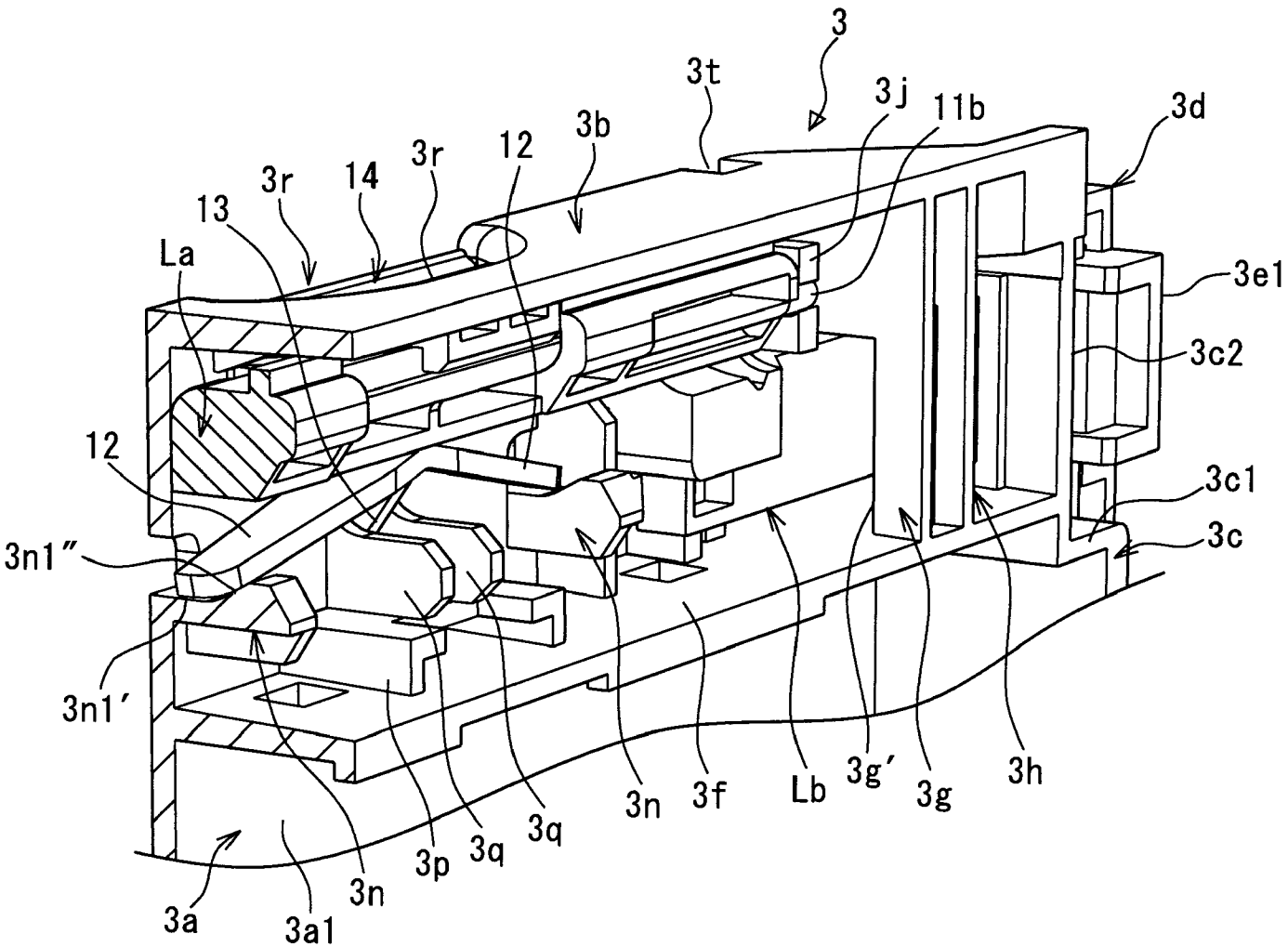
FIG. 17 is a partial perspective view showing the lock state of the folding container according to the present invention and including a partial vertically sectional view.
Figure 18:
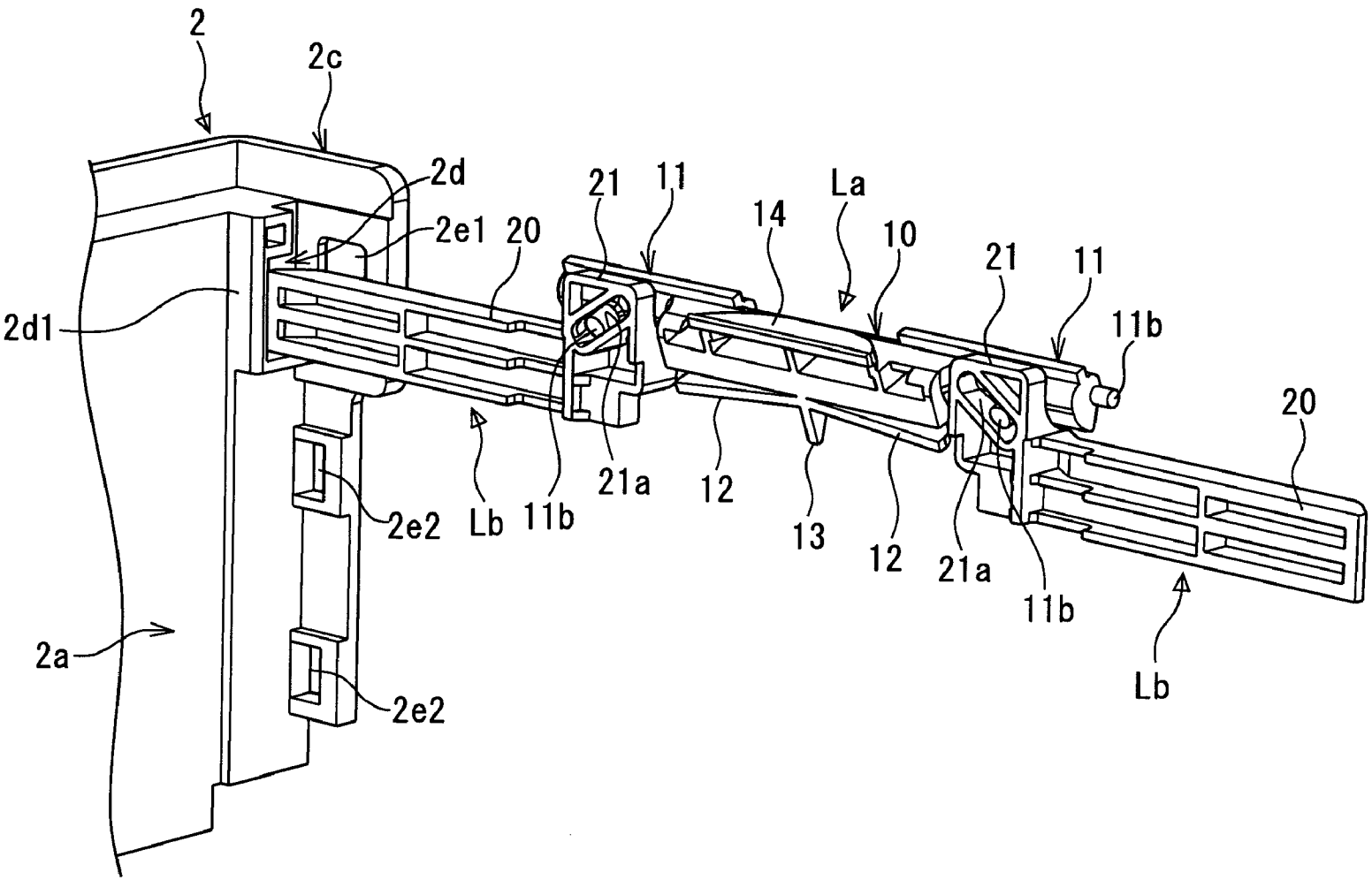
FIG. 18 is a partial perspective view showing the unlock state of the folding container according to the present invention, with the short side wall omitted from the figure.

Furthermore, with the folding container assembled in the box form, the tip portion 12*b* of the inclined spring member 12 formed on the central portion of the bottom surface of the operation main body 10 of the operation portion La is placed on the horizontal surface 3*n*1' forming the top surface 3*n*1 of the spring receiving support block 3*n* formed in the central space portion A1 of the short side wall 3 as shown in FIG. 17.

Figure 19:
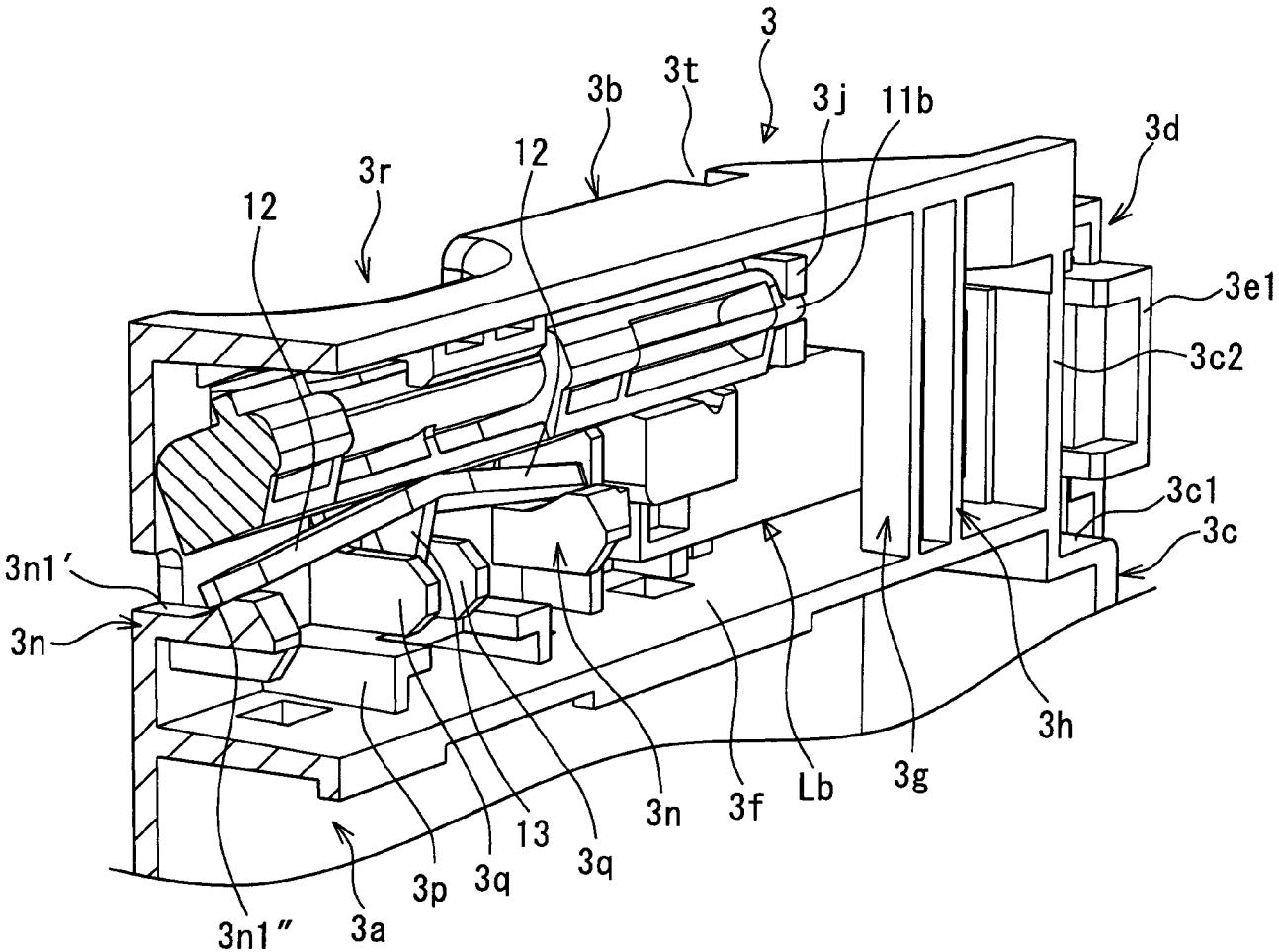
FIG. 19 is a partial perspective view showing the unlock state of the folding container according to the present invention and including a partial vertically sectional view.

To fold the folding container assembled in the box form, the operator first presses the operator's finger against the top surface 14*a* of the circular-arc operation portion 14 of the operation portion La included in the lock member L attached to the short side wall 3. Thus, the operation portion La is pivotally moved downward toward the interior of the folding container using, as a pivotal support point, the pivotal shaft 11*b* of the operation portion La fitted in the fitting recess portion 3*j*1 of the pivotal shaft support block 3*j* formed on the plate-like portion 3*a* of the short side wall 3. Then, as shown in FIG. 19, the tip portion 12*b* of the inclined spring member 12 formed on the operation main body 10 of the operation portion La is moved from the horizontal surface 3*n*1' toward the inclined surface 3*n*1" of the spring receiving support block 3*n* formed on the short side wall 3. The tip portion 12*b* thus comes into abutting contact with the inclined surface 3*n*1". Consequently, against the elastic force of the inclined spring member 12, the tip portion 12*b* of the inclined spring member 12 is elastically deformed in the direction in which the opposite tip portions 12*b* move away from each other, in other words, in the direction in which the tip portion 12*b* of the inclined spring member 12 approaches the operation main body 10 of the operation portion La. The downward pivotal movement of the operation portion La moves the driven pin 15 of the operation portion La positioned near the upper end of the inclined cam groove 21*a* drilled in the cam plate 21 of the lock bar Lb, toward the lower end of the inclined cam groove 21*a*. When the driven pin 15 thus moves toward the lower end of the inclined cam groove 21*a*, the paired lock bars Lb move horizontally in the direction in which the lock bars Lb approach each other. As shown in FIG. 19, the tip portion of the bar-like member 20 of the lock bar Lb is removed from the engaging recess portion 2*d* formed in the long side wall 2. Thus, the short side wall 3 locked on the long side wall 2 is unlocked via the lock member L. Then, each of the short side walls 3 is brought down toward and laid on top of the bottom portion 1. Each of the long side walls 2 is thereafter brought down toward the bottom portion 1 and thus laid on top of the short side walls 3 placed on the bottom portion 1. In this manner, the folding container assembled in the box form can be folded.

As described above, the operation portion La of the lock member L is pivotally moved downward using, as a pivotal support point, the pivotal shaft 11*b* of the operation portion La fitted in the fitting recess portion 3*j*1 of the pivotal shaft support block 3*j* formed on a part of the plate-like portion 3*a* which is positioned in the central space portion A1 of the short side wall 3. Thus, at whichever position the operator's finger is laid on the top surface 14*a* of the operation portion 14 formed on the operation main body 10 of the operation portion La, the lateral paired lock bars Lb disposed opposite each other across the operation portion La move in the horizontal direction by the same amount. Consequently, the lock state established between the short side wall 3 and the long side wall 2 via the lock member L can be reliably canceled.

Furthermore, the operation portion La and the lock bars Lb forming the lock member L located in the central space portion A1 formed in the short side wall 3 are covered with the cover member 4. This prevents the operation portion La and the lock bars Lb forming the lock member L located in the central space portion A1 from being exposed to the outside of the short side wall 3. Thus, the operation portion La and the lock bars Lb forming the lock member L located in the central space portion A1 can be prevented from being damaged by an external member.

Moreover, to carry the folding container assembled in the box form, the operator, by way of example, lays the operators' hand on the bottom surface of the upper horizontal rib 3*f* of the short side wall 3 or inserts the operator's hand into a handheld recess portion or through-hole formed in a part of the plate-like portion 3*a* positioned near the bottom of the upper horizontal rib 3*f*. In this case, the operation portion La of the lock member L operated by the operator is disposed in the operation portion inserting space portion A2 formed in the central portion of the inner upper corner portion of the short side wall 3. The operation portion La is further configured to move pivotally toward the interior of the folding container. Thus, in carrying the folding container assembled in the box form, the operator can be reliably prevented from accidentally touching and pivotally moving the operation portion La downward.

On the tip portion 12*b* of the inclined spring member 12 formed on the operation main body 10 of the operation portion La, a curved portion 12*b*1 is preferably formed on a corner portion of the tip portion 12*b* positioned on the side of the inclined surface 3*n*1" of the spring receiving support block 3*n*. The curved portion 12*b*1 thus formed allows the inclined spring member 12 to move smoothly from the horizontal surface 3*n*1' to inclined surface 3*n*1" of the spring receiving support block 3*n*. This also enables a reduction in the movement of the inclined spring member 12 toward the spring receiving and supporting vertical rib 3*m*.

I claim:

1. A folding container having first opposite side walls which, when the folding container is in an assembled box form, are brought down firstly toward a bottom portion and second opposite side walls which are brought down secondly toward the bottom portion after the first opposite side walls have been brought down, the folding container being characterized in that a lock member comprising one operation portion biased by an inclined spring member and paired lock bars is attached to each of the side walls to be brought down firstly, and a driven pin formed on the operation portion is inserted through an inclined cam groove formed in each of the lock bars, and the lock member is attached to the side wall to be brought down firstly by fitting a pivotal shaft formed on the operation portion into a fitting recess portion of a pivotal shaft support block formed on the side wall to be brought down firstly.

2. The folding container according to claim 1, characterized in that a lock state between the side wall to be brought down firstly and the side wall to be brought down secondly is cancelled by pivotally moving the operation portion of the lock member, downward toward an interior of the folding container using, as a pivotal support point, the pivotal shaft formed on the operation portion fitted in the fitting recess portion of the pivotal shaft support block formed on the side wall to be brought down firstly.

3. The folding container according to claim 1, characterized in that the inclined cam groove formed in the lock bar and a central space portion formed in the side wall to be brought down firstly are covered with a cover member.

4. The folding container according to claim 2, characterized in that the inclined cam groove formed in the lock bar and a central space portion formed in the side wall to be brought down firstly are covered with a cover member.

* * * * *